US010017980B2

(12) United States Patent
Saunders et al.

(10) Patent No.: US 10,017,980 B2
(45) Date of Patent: Jul. 10, 2018

(54) WINDOW MULL SYSTEM

(71) Applicant: Milgard Manufacturing Incorporated, Taylor, MI (US)

(72) Inventors: Melvin Saunders, Auburn, WA (US); Michael Kuneman, Auburn, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 0 days.

(21) Appl. No.: 14/609,384

(22) Filed: Jan. 29, 2015

(65) Prior Publication Data

US 2015/0233169 A1 Aug. 20, 2015

Related U.S. Application Data

(63) Continuation-in-part of application No. 14/330,199, filed on Jul. 14, 2014, now Pat. No. 9,316,040, and a continuation-in-part of application No. 13/704,491, filed as application No. PCT/US2011/039137 on Jun. 3, 2011, now Pat. No. 9,091,116.

(60) Provisional application No. 61/351,771, filed on Jun. 4, 2010, provisional application No. 61/846,683, filed on Jul. 16, 2013.

(51) Int. Cl.

| | |
|---|---|
| ***E06B 1/60*** | (2006.01) |
| *E06B 1/34* | (2006.01) |
| *E06B 1/36* | (2006.01) |

(52) U.S. Cl.

CPC ..... *E06B 1/6007* (2013.01); *E06B 1/34* (2013.01); *E06B 1/36* (2013.01)

(58) Field of Classification Search

CPC ..... E06B 1/6007; E06B 1/366; E06B 3/5427; E06B 3/5418; E06B 3/66; E06B 3/6608; E06B 3/663; E06B 1/36; E04B 2/96; E04B 2/60

See application file for complete search history.

(56) References Cited

U.S. PATENT DOCUMENTS

| | | | |
|---|---|---|---|
| 3,057,444 | A | 10/1962 | Nathan |
| 3,389,527 | A | 6/1968 | Collard |
| 3,719,014 | A | 3/1973 | Sukolics |
| 3,974,608 | A | 8/1976 | Grearson |
| 4,128,983 | A | 12/1978 | Matsubara |
| 4,355,676 | A | 10/1982 | Lee |

(Continued)

FOREIGN PATENT DOCUMENTS

| | | | |
|---|---|---|---|
| JP | 04047060 | A * | 2/1992 |
| WO | 9958782 | A | 11/1999 |

(Continued)

*Primary Examiner* — Charles A Fox
*Assistant Examiner* — Charissa Ahmad
(74) *Attorney, Agent, or Firm* — Rathe Lindenbaum LLP

(57) ABSTRACT

A system for mulling a plurality of fenestration assemblies in an opening includes a first fenestration assembly having a top surface and a first groove extending therein and a second fenestration assembly having a top surface and a second groove extending therein. A mull connector operatively connects the first fenestration assembly and second fenestration assembly together. A sealing cap is positioned on top of the mull connector and includes a first portion positioned on a first side of a line groove line defined by the first groove and the second groove, and a second portion positioned on the second opposite side of the line groove.

15 Claims, 20 Drawing Sheets

(56) References Cited

U.S. PATENT DOCUMENTS

| | | | | |
|---|---|---|---|---|
| 4,428,171 | A | 1/1984 | Harbin | |
| 4,606,162 | A | 8/1986 | Wendt | |
| 4,608,793 | A | 9/1986 | Yost et al. | |
| 4,650,702 | A | 3/1987 | Whitmyer | |
| 4,663,896 | A | 5/1987 | Dunnick | |
| 4,766,709 | A | 8/1988 | Galbraith | |
| 4,768,316 | A * | 9/1988 | Haas | E06B 1/36 49/504 |
| 4,821,472 | A * | 4/1989 | Tix | E06B 1/6015 52/204.55 |
| 4,934,115 | A | 6/1990 | Nozaki | |
| 4,999,957 | A * | 3/1991 | Kessler | E06B 1/6015 49/504 |
| 5,119,609 | A * | 6/1992 | Tait | E06B 1/6015 206/321 |
| 5,133,108 | A | 7/1992 | Esnault | |
| 5,355,645 | A | 10/1994 | Farag | |
| 5,435,106 | A | 7/1995 | Garries et al. | |
| 5,515,652 | A | 5/1996 | Klimek | |
| 5,540,019 | A | 7/1996 | Beske et al. | |
| 5,560,155 | A | 10/1996 | Back | |
| 5,937,597 | A | 8/1999 | Sono et al. | |
| 5,950,380 | A | 9/1999 | Pearson | |
| 6,360,498 | B1 | 3/2002 | Westphal | |
| 6,857,233 | B2 | 2/2005 | Farag | |
| D565,199 | S | 3/2008 | Westphal | |
| 7,676,999 | B2 * | 3/2010 | Arias | E06B 3/5427 292/175 |
| 8,266,851 | B2 | 9/2012 | Campbell et al. | |
| 8,464,480 | B2 | 6/2013 | Libby et al. | |
| 8,904,720 | B2 | 12/2014 | Woodward et al. | |
| 2002/0011039 | A1 | 1/2002 | Edger | |
| 2002/0092248 | A1 | 7/2002 | Westphal | |
| 2003/0217523 | A1 | 11/2003 | Budzinski | |
| 2008/0016800 | A1 | 1/2008 | Tufts et al. | |
| 2008/0110094 | A1 | 5/2008 | Davies | |
| 2008/0216424 | A1 | 9/2008 | Westphal et al. | |
| 2008/0302036 | A1 | 12/2008 | McMahon | |
| 2010/0218455 | A1 * | 9/2010 | Tufts | E06B 1/36 52/745.16 |
| 2013/0212973 | A1 | 8/2013 | Saunders et al. | |

FOREIGN PATENT DOCUMENTS

| | | | |
|---|---|---|---|
| WO | WO 0181700 | A1 * | 11/2001 |
| WO | 2011153479 | A1 | 12/2011 |

* cited by examiner

WINDOW MULL SYSTEM

CROSS-REFERENCE TO RELATED PATENT APPLICATIONS

The present application is a continuation-in-part of application Ser. No. 14/330,199 filed Jul. 14, 2014 which claims the benefit of U.S. Provisional Application Ser. No. 61/846,683, filed Jul. 16, 2013, and is a continuation-in-part of application Ser. No. 13/704,491 filed Dec. 14, 2012 which was a national stage entry of PCT/US11/39137 filed Jun. 3, 2011 which claims the benefit of U.S. Provisional Application 61/351,771 filed Jun. 4, 2010, all of the above referenced applications are herein incorporated by reference in their entirety.

BACKGROUND OF THE INVENTION

The present invention relate generally to fenestration assemblies and in particular to a system and method for field mulling of windows and doors.

Window and door units are sometimes grouped together and installed into one opening in the building that must first be connected together and sealed. This connection of units is called mulling. Units can be mulled in the factory (Factory Mulled) or on the jobsite prior to installation (Field Mulled). Factory mulled windows are typically preferred. Field mulling is used when factory mulling cannot be performed due to size, weight or shipping limits. Field mulling adds labor and complexity because the installer must assemble and seal the unit prior to installation. Once mulled on the jobsite the oversized units must be lifted into the opening which risks injury to the installers as well as damage to the mulled unit.

It would be desirable to provide a system and method for both factory mulling and field mulling two or more fenestration assemblies (e.g., windows and/or doors) that allows each fenestration assembly to be installed in an opening of a building one at a time or together.

SUMMARY OF THE INVENTION

A system for mulling a plurality of fenestration assemblies in an opening includes a first fenestration assembly having a top surface and a first groove extending therein and a second fenestration assembly having a top surface and a second groove extending therein. A mull connector operatively connects the first fenestration assembly and second fenestration assembly together. A sealing cap is positioned on top of the mull connector and includes a first portion positioned on a first side of a line groove line defined by the first groove and the second groove, and a second portion positioned on the second opposite side of the line groove In accordance with an embodiment, a system for field mulling a plurality of fenestration assemblies in an opening includes a first fenestration assembly positioned in the opening, the first fenestration assembly comprising a mull halve a second fenestration assembly positioned in the opening adjacent to the first fenestration assembly, the second fenestration assembly having a mull halve and positioned so that the second fenestration assembly mull halve is adjacent to the first fenestration assembly mull halve and at least one H-shaped mull connector coupled to the first fenestration assembly mull halve and the second fenestration assembly mull halve.

In accordance with another embodiment, a mulling assembly for field mulling a plurality of fenestration assemblies in an opening includes a first mull halve having an interior side and an exterior side, a second mull halve having an interior side and an exterior side, a first mull connector coupled to the interior side of the first mull halve and the interior side of the second mull halve, the first mull connector having an H-shape and a second mull connector coupled to the exterior side of the first mull halve and the exterior side of the second mull halve, the second mull connector having an H-shape.

In accordance with another embodiment, a mulling assembly for field mulling a plurality of fenestration assemblies in an opening includes a first mull halve having an interior side and an exterior side, the first mull halve comprising a hook-shaped connector on the exterior side, a second mull halve having an interior side and an exterior side, the second mull halve comprising a tab on the exterior side, wherein the tab is configured to be received by the hook-shaped connector of the first mull halve to join the first mull halve and the second mull halve and a first mull connector coupled to the interior side of the first mull halve and the interior side of the second mull halve, the first mull connector having an H-shape.

In another embodiment a method for mulling a plurality of fenestration assemblies includes providing a first fenestration assembly having a top surface and a first groove extending therein; providing a second fenestration assembly having a top surface and a second groove extending therein; connecting the first fenestration assembly and second fenestration assembly together with a mull connector; and securing a sealing cap on top of the mull connector, the securing sealing cap having a first portion positioned on a first side of a line groove line defined by the first groove and the second groove, and a second portion positioned on the second opposite side of the line groove.

In accordance with another embodiment, a method for field mulling a plurality of fenestration assemblies on an opening includes positioning a first fenestration assembly in the opening, the first fenestration assembly having a mull halve, connecting the first fenestration assembly to a frame of the opening, positioning a second fenestration assembly in the opening adjacent to the first fenestration assembly, the second fenestration assembly having a mull halve and wherein the second fenestration assembly is positioned so that the second fenestration assembly mull halve is adjacent to the first fenestration assembly mull halve, connecting the second fenestration assembly to the frame of the opening and connecting the first fenestration assembly mull halve to the second fenestration assembly mull halve using at least one H-shaped connector.

DETAILED DESCRIPTION OF THE PREFERRED EMBODIMENTS

The following description discusses a system and method for field mulling two or more fenestration assemblies (e.g., windows and/or doors). While the following description refers to windows, it should be understood that the systems and methods described herein may also be used with other types of fenestration assemblies (e.g., doors). For the purposes of this application, the term "exterior" will refer to the direction toward the outside of an enclosure or building while the term "interior" will refer to the direction toward the inside of the enclosure or building.

Figure 1:
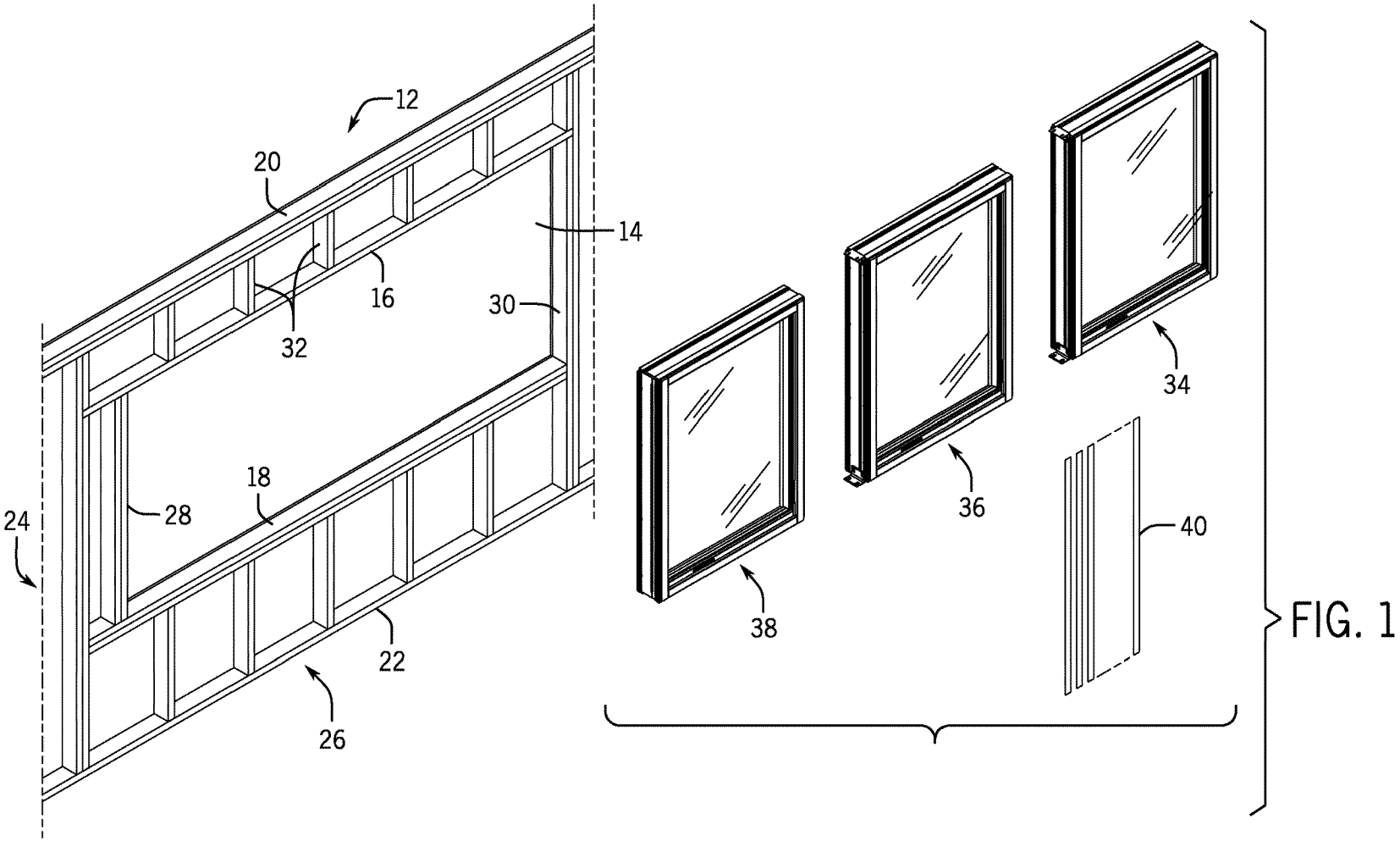
FIG. 1 is a perspective view of a building wall frame and multiple fenestration assemblies in accordance with an embodiment.

FIG. 1 is a perspective view of a building wall frame and multiple fenestration assemblies in accordance with an embodiment. The building (or other enclosure) wall frame 12 includes an opening 14 defined by a header 16, a sill 18 and jambs 28 and 30. Wall frame 12 also includes a top plate 20, a bottom plate 22 and studs 32. The opening 14 is designed to receive multiple windows. In FIG. 1, a first window 34, a second window 36 and a third window 38 may be installed in the opening 14 of wall frame 12 and mulled together within the opening using the systems and methods described herein. Wall frame 12 and windows 34, 36, 28 have an exterior side 24 and an interior side 26. It should be understood the field mulling systems and method described herein may be used with other types of windows than shown in FIGS. 1-20, such as, for example, casement, single hung, double hung, horizontal sliding windows or any other operating style of window. It should also be noted that a structure with three separate fenestration assemblies (e.g., windows 34, 36, 38) is exemplary and that in various embodiments two or more separate fenestration assemblies may be used. The two or more fenestration assemblies are designed to be installed in an opening side-by-side as illustrated by item 40.

Figure 2:
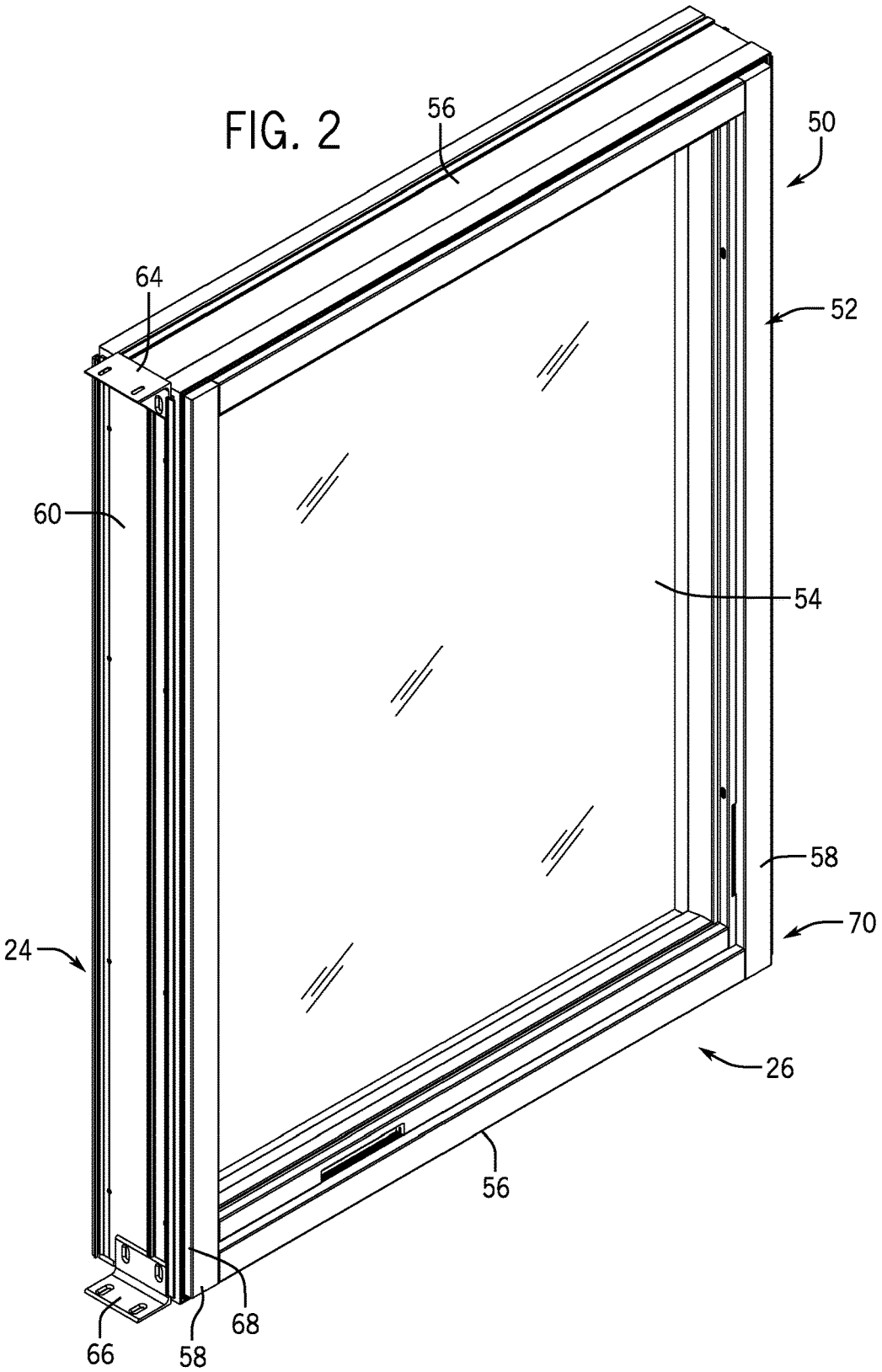
FIG. 2 is a perspective view of a window with a mull halve in accordance with an embodiment.

A mull assembly is provided to facilitate the mulling of the first window 34 and the second window 36 and the mulling of the second window 36 and the third window 38. FIG. 2 is a perspective view of a window with a mull halve in accordance with an embodiment. Window 50 (e.g., first window 34, second window 36 or third window 38) includes a frame 52 with rails 56 and stiles 58. A glazing 54 is housed within the frame 52. A first side 68 of frame 52 is perpendicular to an exterior side 24 and an interior side 26 of the frame 52. A second side 70 of frame 52 is perpendicular to the exterior side 24 and the interior side 26 of the frame 52 and parallel to the first side 68 of the frame 52. A mull halve 60 is attached to the first side 68. In one embodiment, the mull halve is secured to the window 50 prior to the window 50 being installed in an opening. Mull halve 60 is used for field mulling of the window 50 with another window in an opening 14 (shown in FIG. 1). An upper mull bracket 64 and a lower mull bracket 66 are attached to mull halve 60 and used to secure the frame 52 to a wall frame 12 (shown in FIG. 1)

Figure 3:
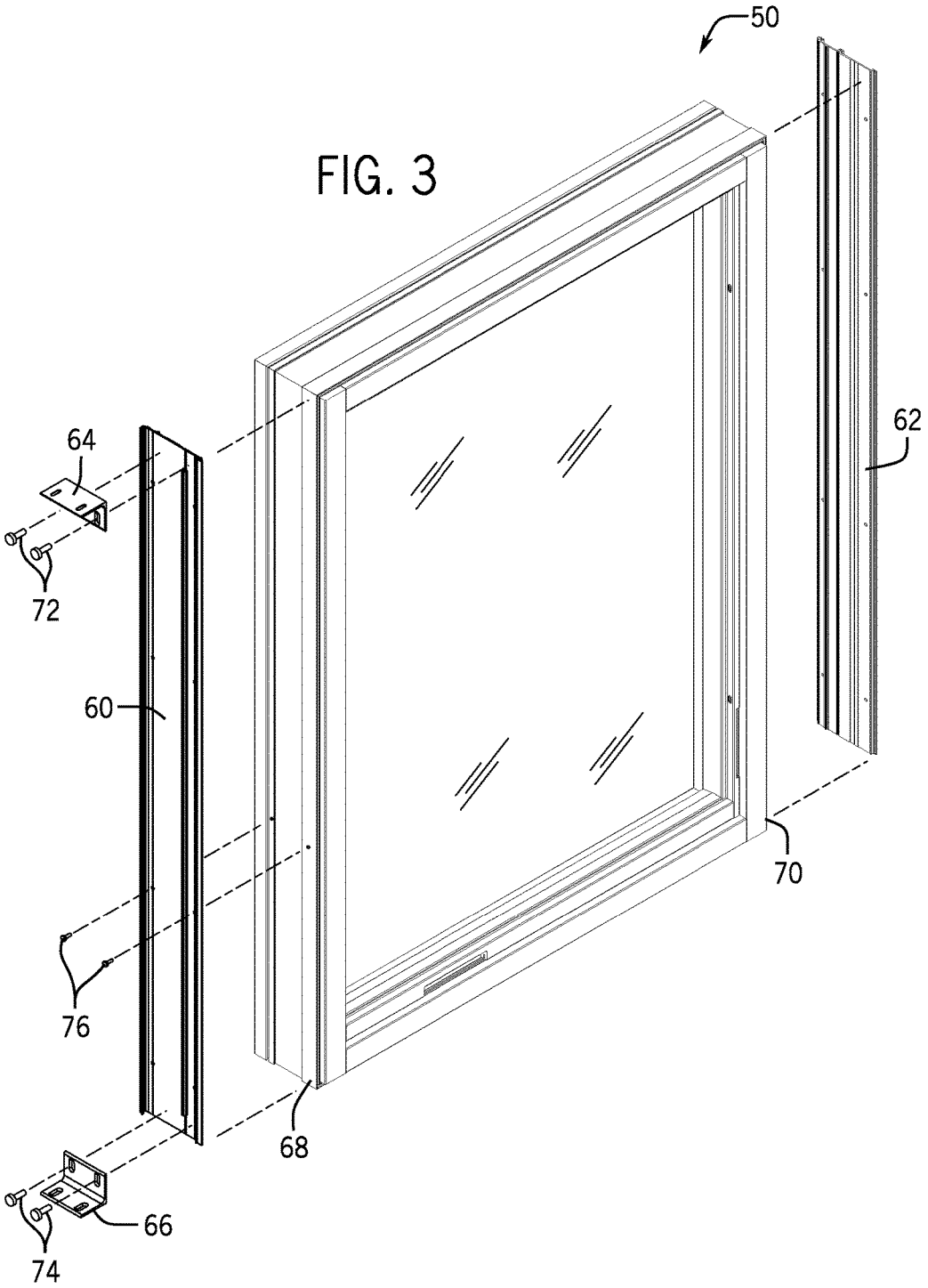
FIG. 3 is a perspective view of a window and a pair of mull halves in accordance with an embodiment.

When a window will be connected with two other windows, the window 50 may also include a second mull halve 62 attached to the second side 72 of the frame 52 as shown in FIG. 3. Mull halve 60 and mull halve 62 are designed to cooperate or interconnect with a mull halve on another window to secure the windows together. Each mull halve 60, 62 may be attached to the frame 52 using mechanical fasteners, for example, screws. For example, in FIG. 3, mull halve 60 may be secured to frame 52 using mechanical fasteners 76. The upper mull bracket 64 may be attached to the frame 52 and mull halve 60 using mechanical fasteners 72. The lower mull bracket 66 may be attached to the frame 52 and mull halve 60 using mechanical fasteners 74.

Figure 4:
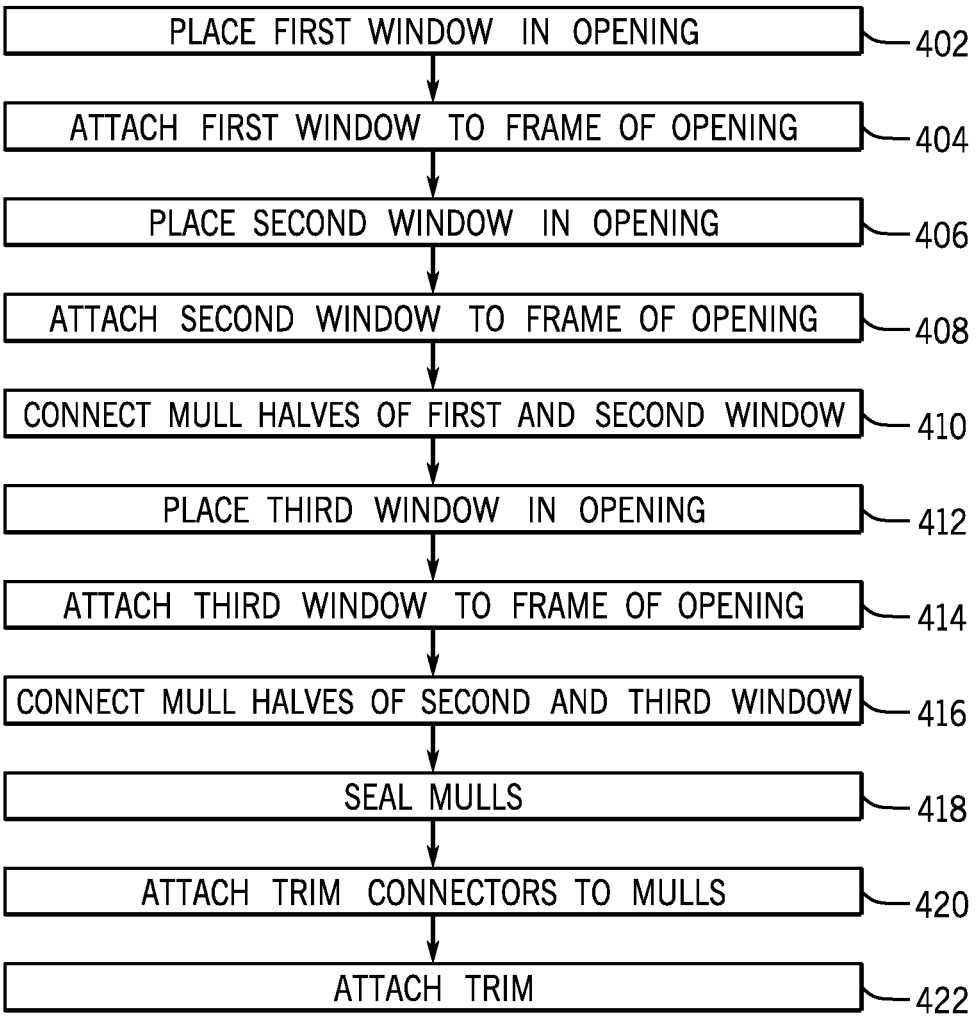
FIG. 4 illustrates a method for field mulling two or more fenestration assemblies in accordance with an embodiment.
Figure 5:
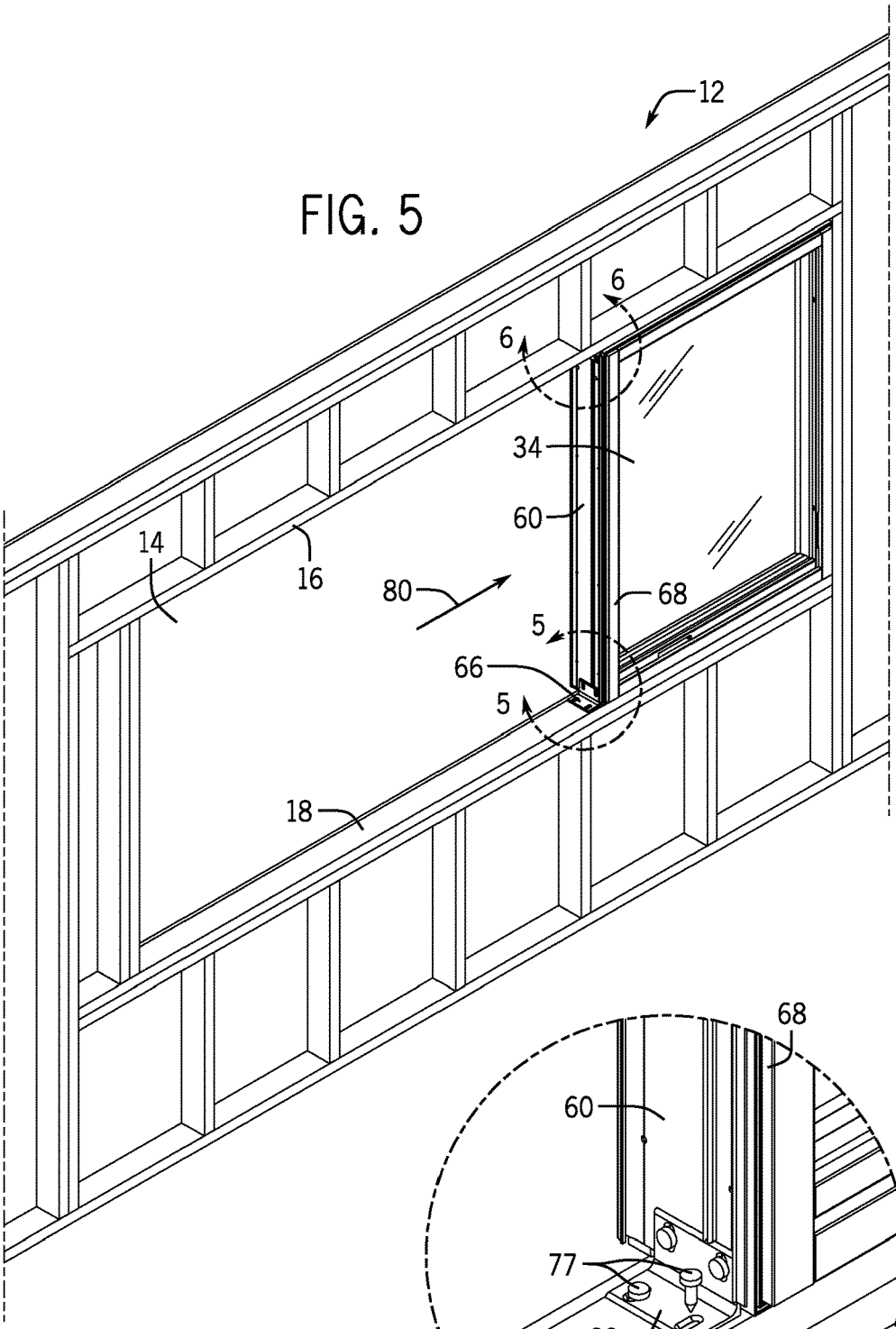
FIG. 5 is a perspective view of a wall frame with a first window installed in accordance with an embodiment.
Figure 6:
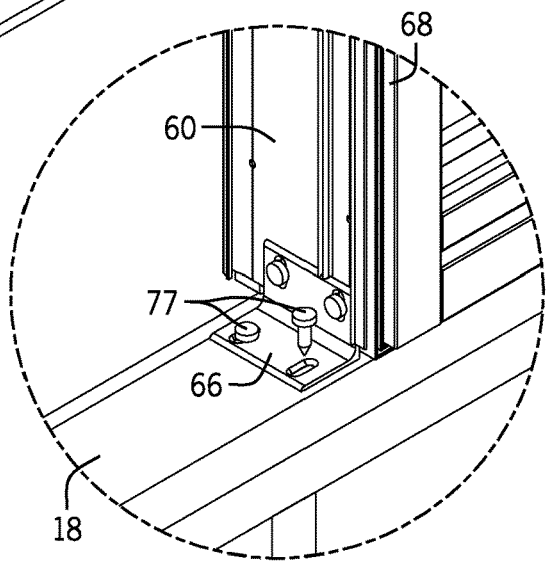
FIG. 6 is a view of a lower mull bracket of FIG. 5 attached to a sill of a wall frame in accordance with an embodiment.
Figure 7:
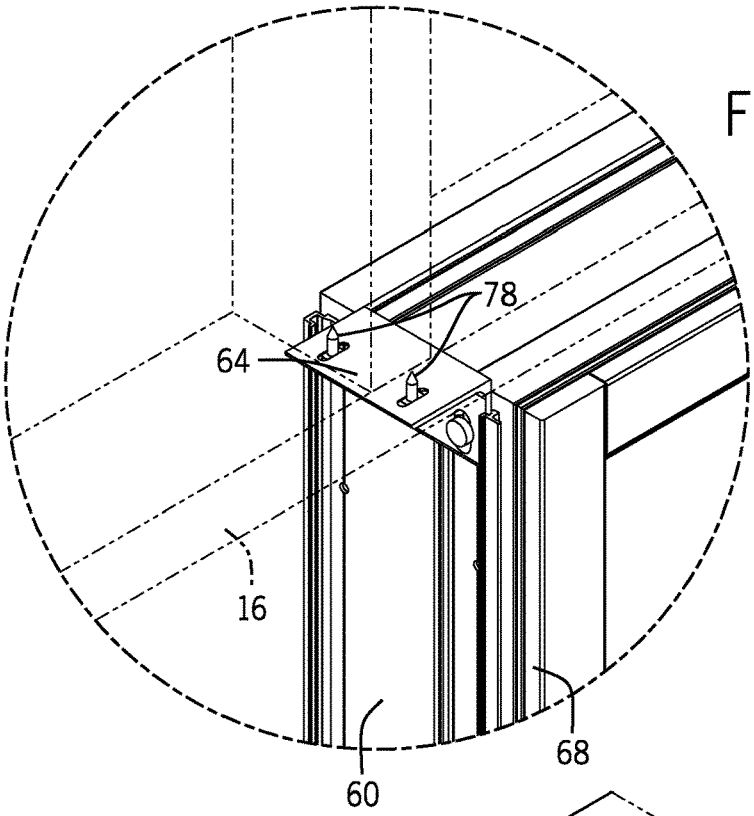
FIG. 7 is a view of an upper mull bracket of FIG. 5 attached to a header of a wall frame in accordance with an embodiment.
Figure 8:
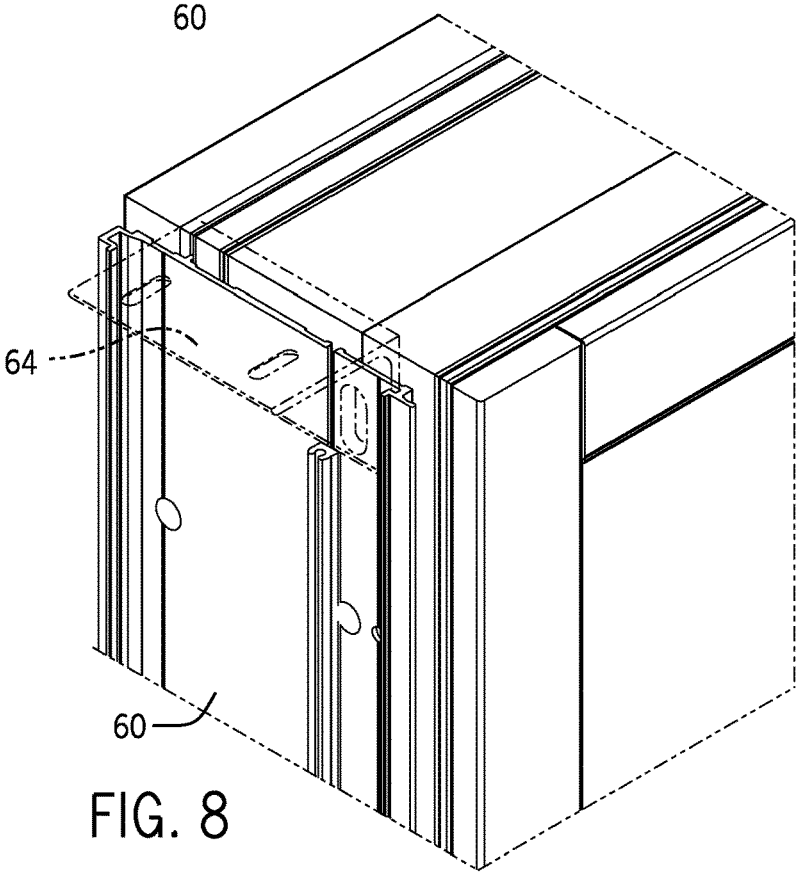
FIG. 8 is a view of a mull halve and an upper mull bracket in accordance with an embodiment.

Two or more windows 50 with a mulling assembly as described herein may be field mulled as described further below with respect to FIGS. 4-20. FIG. 4 illustrates a method for field mulling two or more fenestration assemblies in accordance with an embodiment. At block 402, a first window is placed in an opening, for example, an opening 14 (shown in FIG. 1) in a building wall frame. FIG. 5 is a perspective view of a wall frame with a first window installed in accordance with an embodiment. In FIG. 5, the first window 34 is placed in the opening 14 of wall frame 12 in the direction as shown by arrow 80. The first window may be made plumb, level and square with shims. At block 404 of FIG. 4, the first window 34 is attached to the frame of the opening. For example, the first window 34 may be attached to frame 12 using a nailing fin (not shown). In an embodiment, the frame 52 may include a groove or kerf (not shown) that is used to connect the nailing fin to the frame 52. In addition, the upper mull bracket 64 and lower mull bracket 66 are attached to the wall frame 12 as shown in FIGS. 5-7. In particular, the lower mull bracket 66 may be attached to the sill 18 of the wall frame 12 using mechanical fasteners 77 as shown in FIG. 6. The upper mull bracket 64 may be attached to the header 16 of wall frame 12 using mechanical fasteners 78 as shown in FIG. 7. As mentioned, the upper mull bracket 64 and the lower mull bracket 66 are also attached to the mull halve 60 which is attached to a first side 68 of the window 34. FIG. 8 is a view of a mull halve 60 and an upper mull bracket 64 in accordance with an embodiment. FIG. 8 shows one embodiment of a mull halve 60 structure. Mull halve 60 is designed to cooperate with a mull halve on a second window to facilitate mulling of the first window and the second window as described further below.

Figure 9:
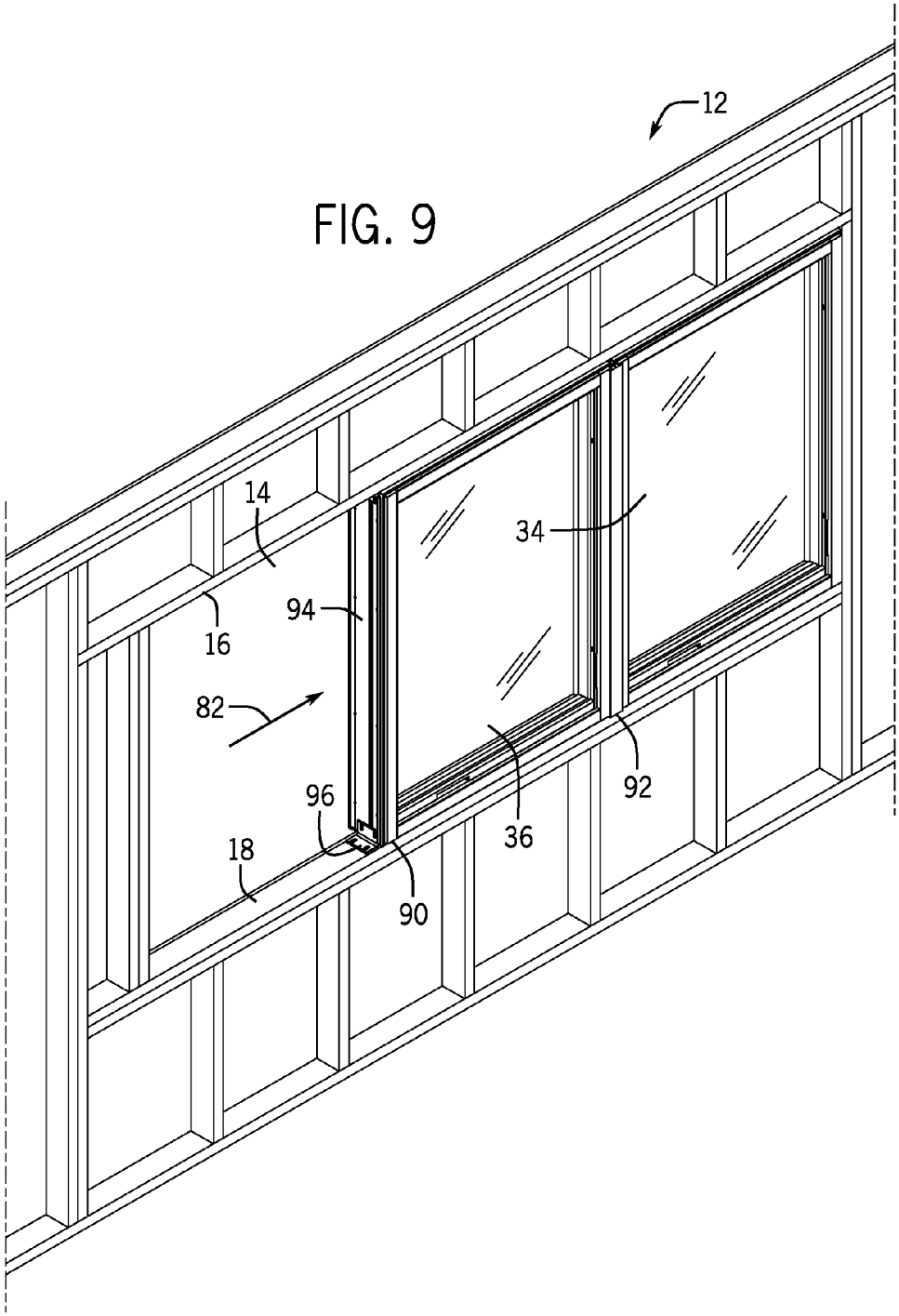
FIG. 9 is a perspective view of a wall frame with two windows installed in accordance with an embodiment.

Returning to FIG. 4, at block 406 a second window is placed in the opening. FIG. 9 is a perspective view of a wall frame with two windows installed in accordance with an embodiment. In FIG. 9, the second window 36 is placed in the opening 14 of wall frame 12 in the direction as shown by arrow 82. The second window 36 is positioned adjacent to the first window 34. The second window may be made plumb, level and square with shims. At block 408 of FIG. 4, the second window 36 is attached to the frame of the opening. For example, the second window 36 may be attached to frame 12 using a nailing fin (not shown). In an embodiment, the frame 52 may include a groove or kerf (not shown) that is used to connect the nailing fin to the frame 52. In addition, the upper mull bracket 64 and lower mull bracket 66 on a first side 90 of the second window 36 may be attached to the wall frame 12 as discussed above with respect to FIGS. 6 and 7.

Figure 10:
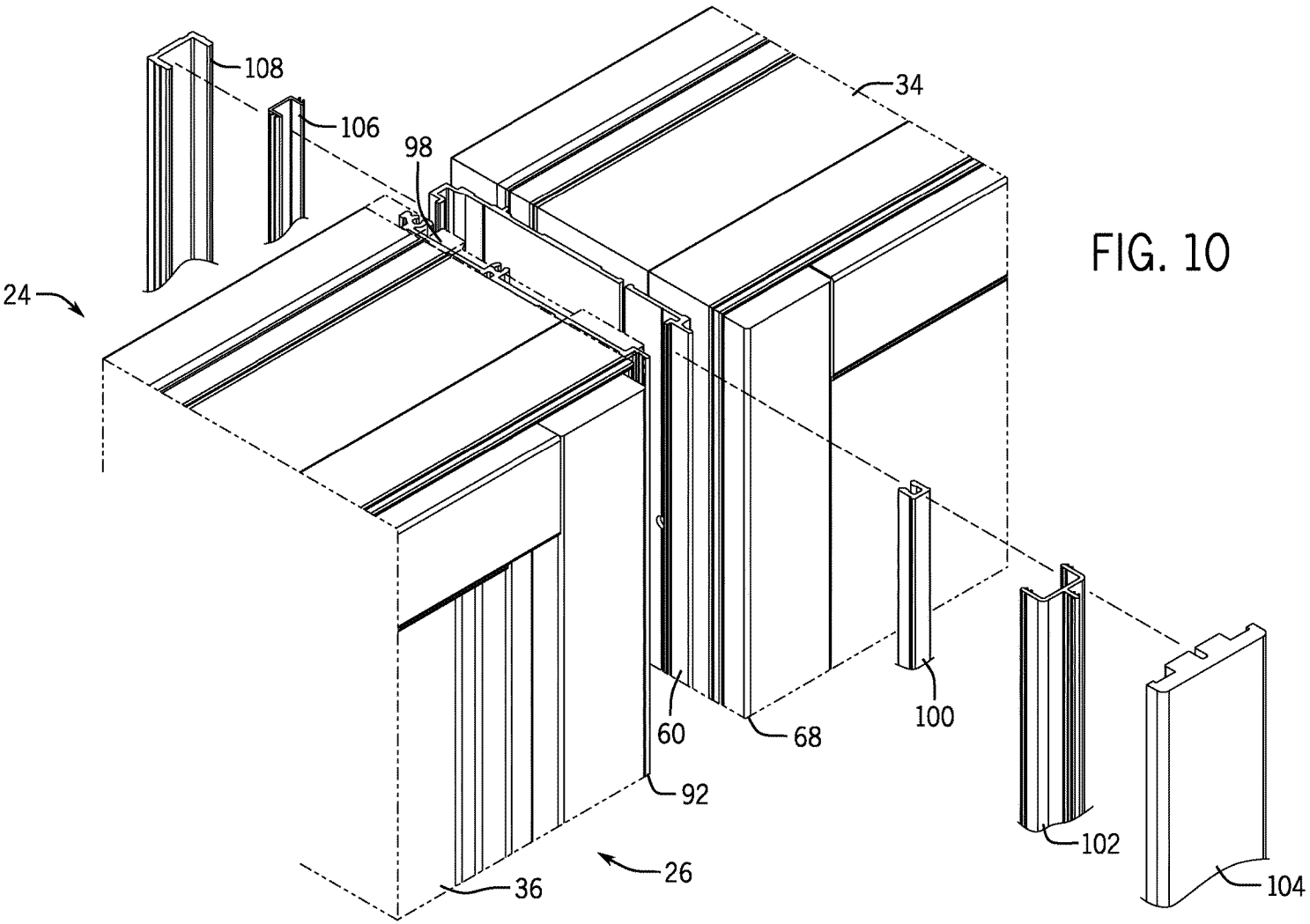
FIG. 10 is a perspective view of components of a mull assembly in accordance with an embodiment.
Figure 13:
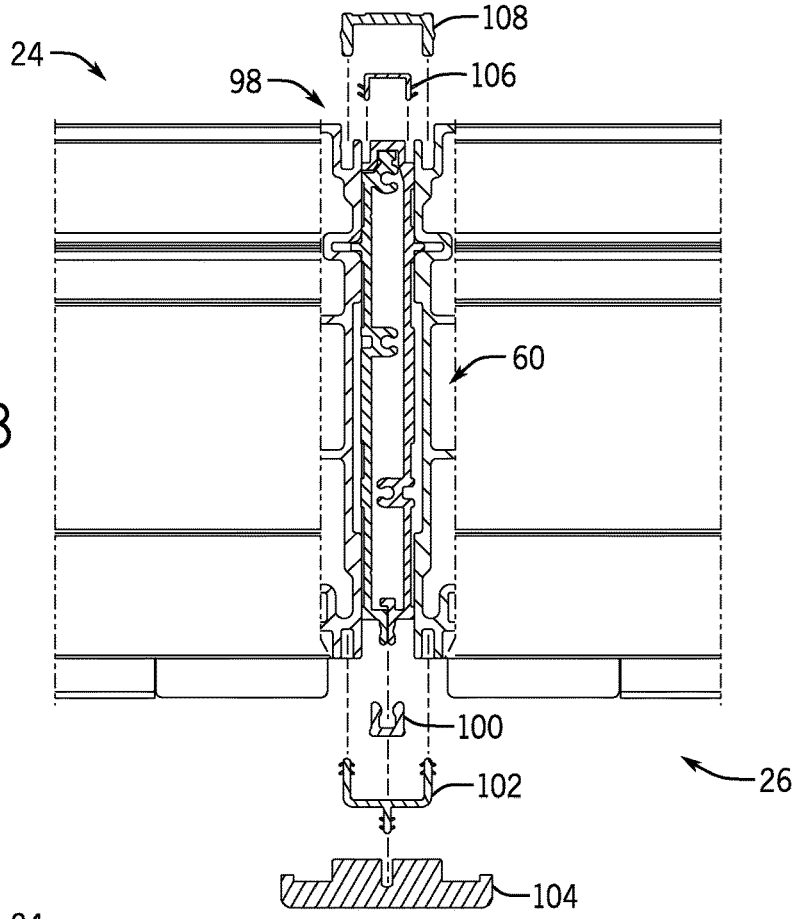
FIG. 13 is a top view of components of a mull assembly in accordance with an embodiment.

Referring again to FIG. 4, at block 410 the mull halve on the first side 68 (shown in FIG. 5) of the first window 34 and the mull halve on the second side 92 (shown in FIG. 9) of the second window 36 are attached or secured together. FIG. 10 is a perspective view of components of a mull assembly in accordance with an embodiment and FIG. 13 is a top view of components of a mull assembly in accordance with an embodiment. In FIGS. 10 and 13, the mull assembly components consist of a mull halve 60 on the first side 68 of a first window 34 and a mull halve 98 on a second side 92 of a second window 36. On the interior side 26, a mull connector 100, a trim connector 102 and an interior trim 104 are used to secure together the mull halves 60, 98. On the exterior side 24, a sealing connector 106 and exterior trim 108 are used to secure together the mull halves 60, 98.

Figure 11:
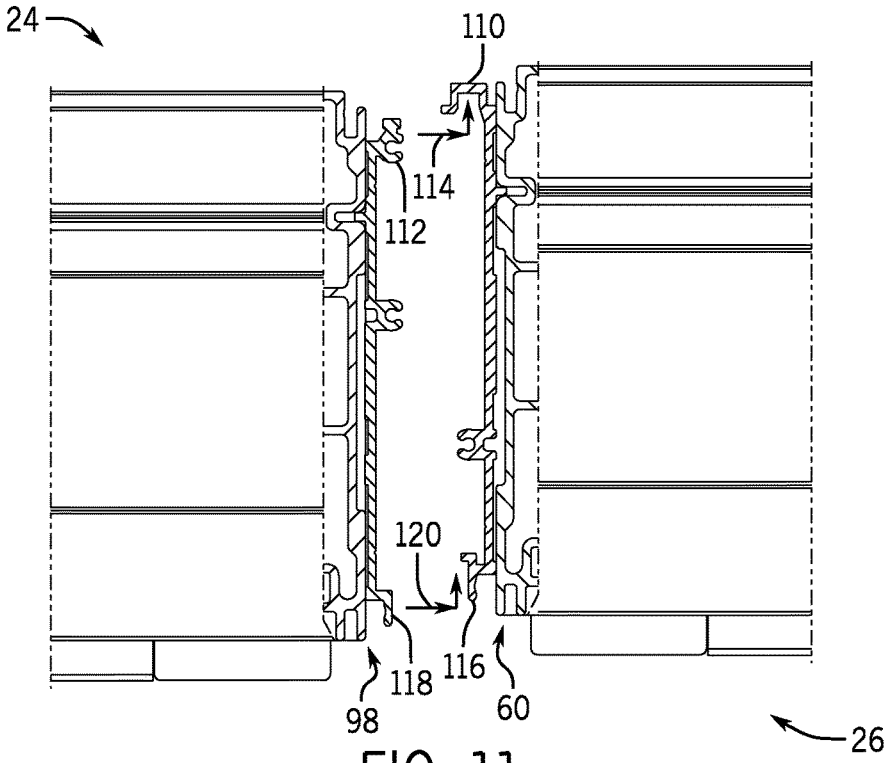
FIG. 11 is a top view of two mull halves in accordance with an embodiment.
Figure 12:
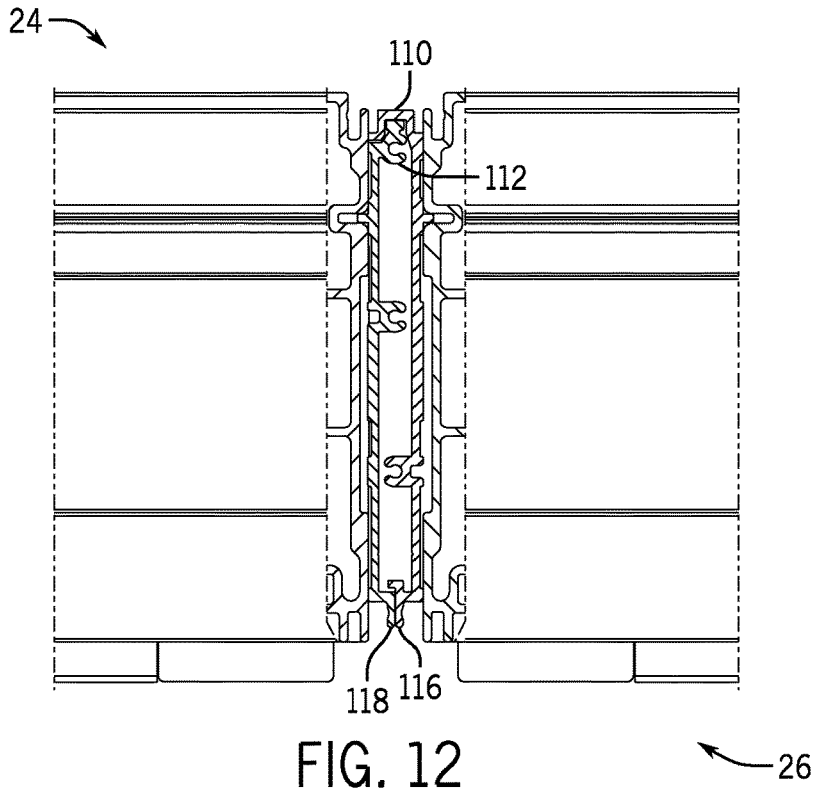
FIG. 12 is a top view of two mull halves in accordance with an embodiment.
Figure 14:
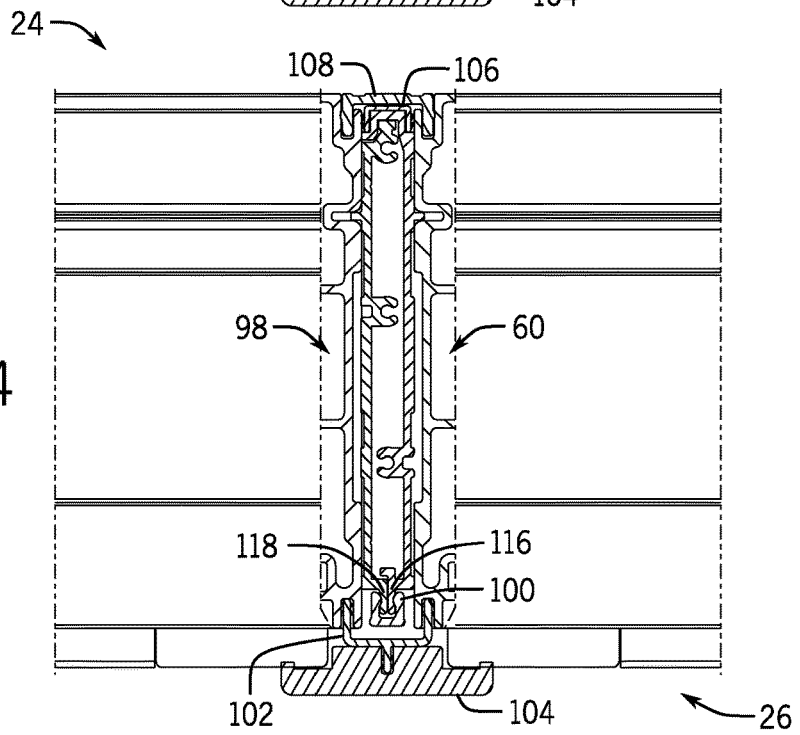
FIG. 14 is a top view of a completed mull assembly in accordance with an embodiment.
Figure 15:
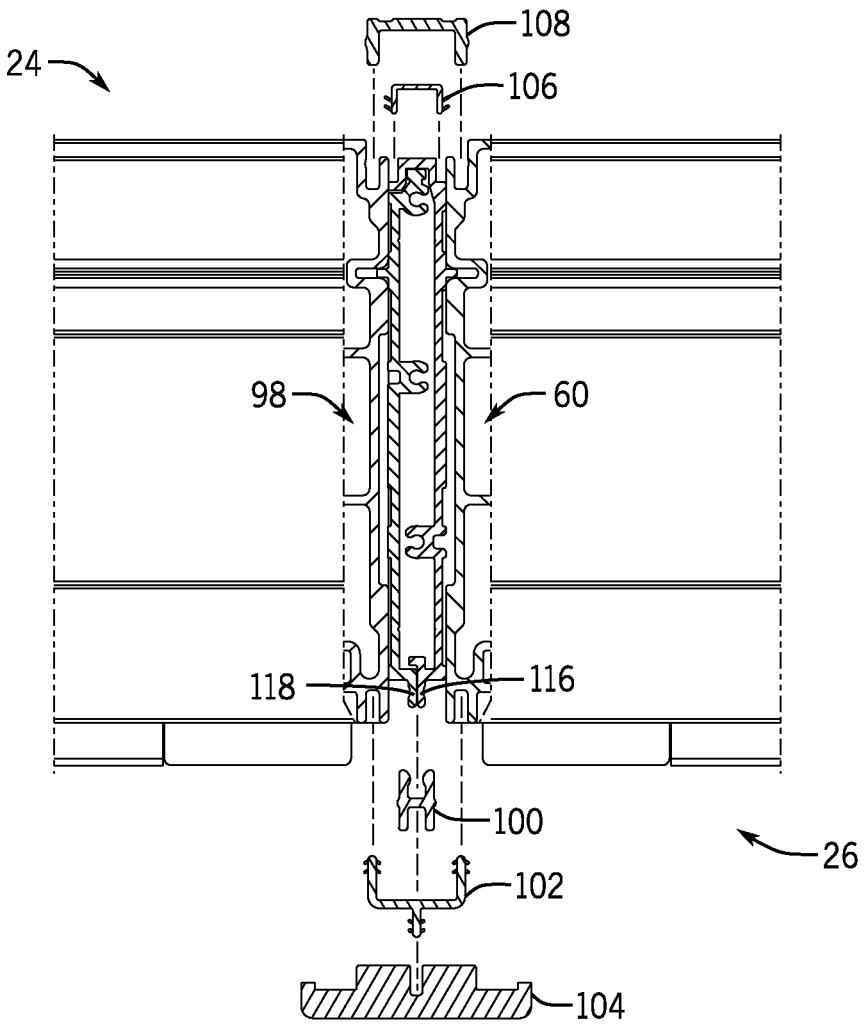
FIG. 15 is a top view of components of a mull assembly in accordance with an embodiment.

As mentioned, the mull halves on each window are designed to cooperate or interconnect. FIG. 11 is a top view of two mull halves in accordance with an embodiment. In FIG. 11, a mull halve 60 on the first window includes a tab 116 on the interior side 26 of the mull halve and a mull halve 98 on the second window includes a tab 118 on the interior side 26 of the mull halve. Mull halve 60 includes a hook-shaped connector 110 on an exterior side of the mull halve and mull halve 98 includes a tab or extension 112 on the exterior side of the mull halve. The tab 112 is designed to be positioned or received in the hook shaped-connector 110 as indicated by arrow 114. Tab 116 and tab 118 are designed to be positioned adjacent to one another as indicated by arrow 120. FIG. 12 shows the two mull halves 60 and 98 after they are positioned next to each other. Tab 112 is positioned in hook-shaped connector 112 to secure the exterior side of the mull halves 60, 98. Tab 116 and 118 are adjacent one another. A mull connector 100 is used to join the tabs 116, 118 on the interior side as shown in FIGS. 13 and 14. Mull connector 100 has a U-shape. In an alternative embodiment, as shown in FIG. 15, the mull connector 100 used to join tab 116 and tab 118 of mull halves 60 and 98, respectively, is an H-shaped connector.

Figure 16:
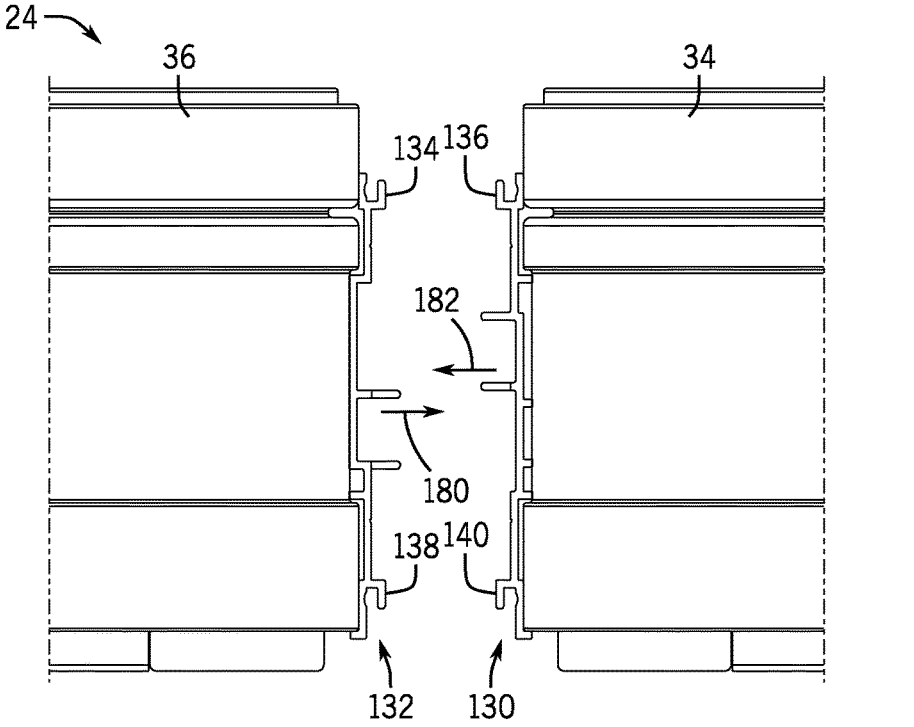
FIG. 16 is a top view of two mull halves in a in accordance with an embodiment.
Figure 17:
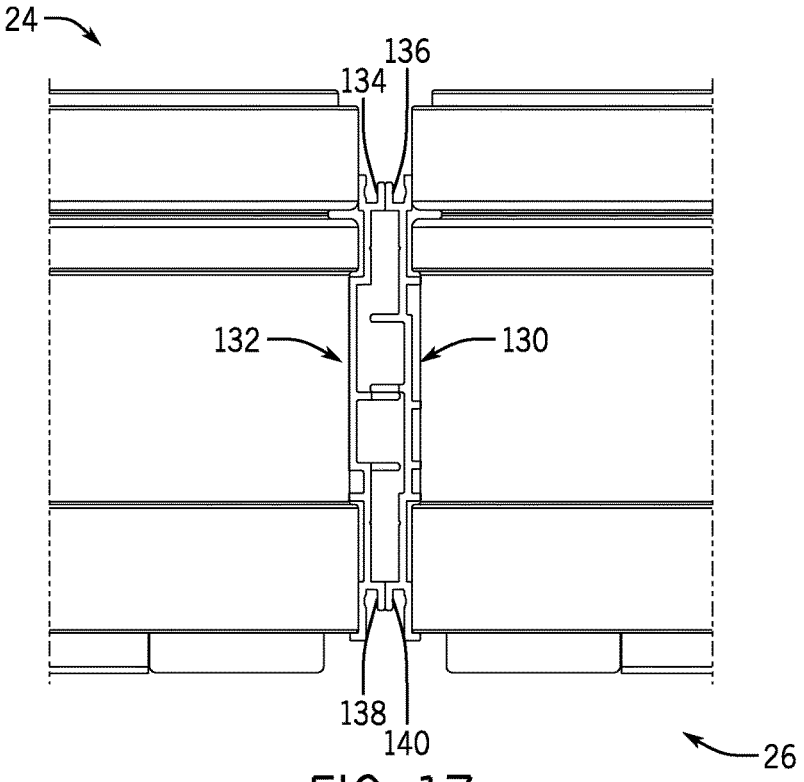
FIG. 17 is a top view of two mull halves in accordance with an embodiment.

In another embodiment, each mull halve may have tabs on the interior and exterior sides and the mull assembly includes two-H-shaped connectors as shown in FIGS. 16-19. FIG. 16 is a top view of two mull halves in accordance with an embodiment. In FIG. 16, a mull halve 130 on a first window includes a tab 136 on the interior side of the mull halve and a mull halve 132 on a second window includes a tab 134 on the interior side of the mull halve. Mull halve 130 includes a tab 140 on an exterior side of the mull halve and mull halve 132 includes a tab 138 on the exterior side of the mull halve. Tab 134 and tab 136 are designed to be positioned adjacent to one another when the two mull halves 130, 132 are brought together as indicated by arrows 180 and 182. Tab 138 and tab 140 are designed to be positioned adjacent to one another when the two mull halves 130, 132 are brought together as indicated by arrows 180 and 182. FIG. 17 shows the two mull halves 60 and 98 after they are positioned next to each other. Tabs 134 and 136 are positioned adjacent one another and tabs 138 and 140 are positioned adjacent to one another.

Figure 18:
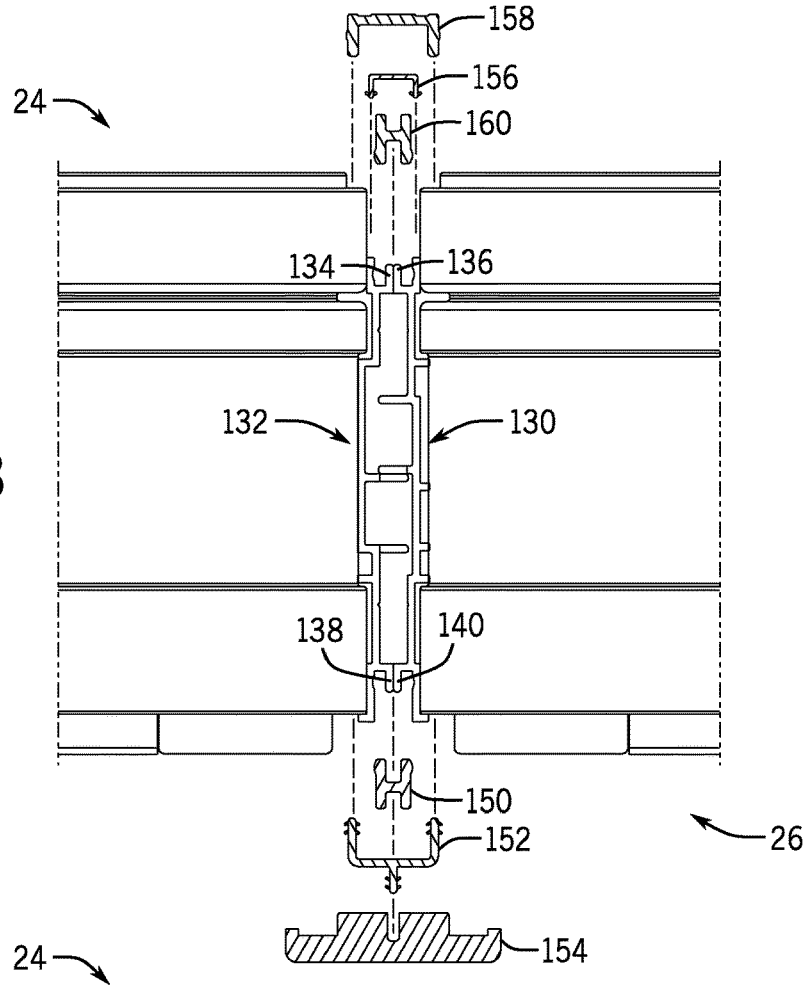
FIG. 18 is a top view of components of a mull assembly in accordance with an embodiment.
Figure 19:
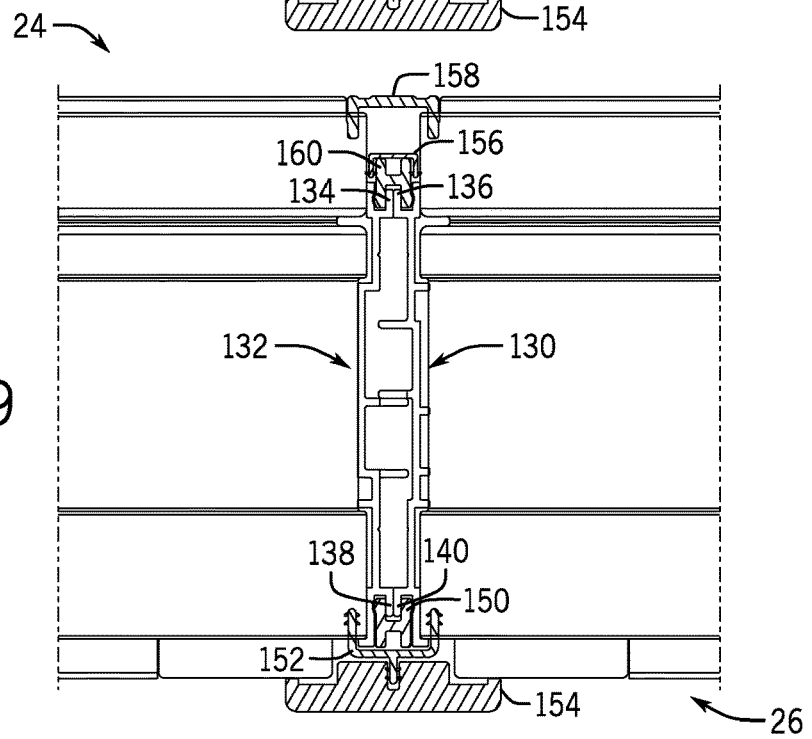
FIG. 19 is a top view of a completed mull assembly in accordance with an embodiment.

FIG. 18 is a top view of components of a mull assembly in accordance with an embodiment. The mull assembly components consist of a mull halve 130 on the first side of a first window and a mull halve 132 on a second side of a second window. On the interior side 26, a mull connector 150, a trim connector 152 and an interior trim 154 are used to secure together the mull halves 130, 132. On the exterior side 24, a mull connector 160, a sealing connector 156 and exterior trim 158 are used to secure together the mull halves 130, 132. The mull connector 150 is used to join the tabs 138, 140 on the interior side as shown in FIGS. 18 and 19. The mull connector 150 is an H-shaped connector. The mull connector 160 is used to join the tabs 134, 136 on the exterior side as shown in FIGS. 18 and 19. The mull connector 160 is an H-shaped connector.

Figure 20:
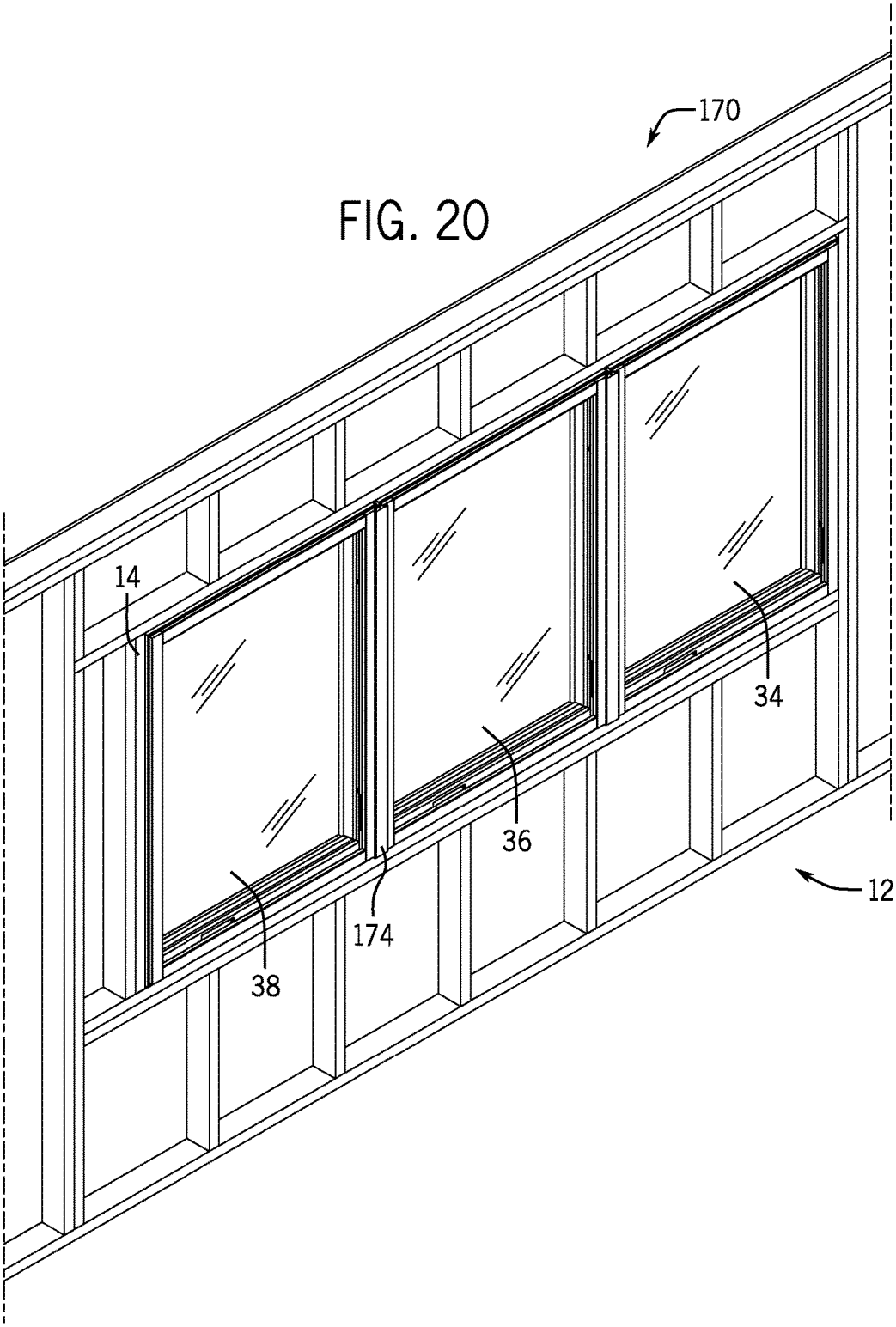
FIG. 20 is a perspective view of a completed mulled window in accordance with an embodiment.

Returning to FIG. 4, at block 412 a third window 38 is placed in the opening 14 of the wall frame 12 as shown in FIG. 20. The third window 38 is installed adjacent to the second window 36 with the mull halves of the second window 36 and third window 38 interconnected. The third window 38 may be made plumb, level and square with shims. At block 414 of FIG. 4, the third window 38 is attached to the frame 12 of the opening 14. For example, the third window 38 may be attached to frame 12 using a nailing fin (not shown). In an embodiment, the frame 52 may include a groove or kerf (not shown) that is used to connect the nailing fin to the frame 52. In addition, the upper mull bracket 64 and lower mull bracket 66 are attached to the wall frame 12 as discussed above with respect to FIGS. 6 and 7.

At block 416 of FIG. 4, the mull halve on the first side 90 (shown in FIG. 9) of the second window 36 and the mull halve on a first side 174 (shown in FIG. 20) of the third window 38 are attached. As described above with respect to FIGS. 11-19, the mull halves are designed to cooperate or interconnect. In one embodiment as shown in FIGS. 11-15, the mull halves 60, 98 include tabs 116, 118 on an interior side 26 and a hook-shaped connector 110 and tab 112 on the exterior side 24 of the mull halves. A mull connector 100 is used to join the tabs 116, 118 on the interior side. The mull connector 100 may be, for example, a U-shaped connector or an H-shaped connector. On the exterior side 24, tab 112 is positioned in the hook-shaped connector 110. In another embodiment as shown in FIGS. 16-19, the mull halves 130, 132 include tabs 138, 140 on an interior side 26 and tabs 134, 136 on an exterior side 24. An H-shaped mull connector 150 is used on the interior side 26 to secure tabs 138, 140 together. An H-shaped mull connector 160 is used on the exterior side 24 to secure tabs 134, 136 together.

Returning to FIG. 4, at block 418, the mull between the first window 34 and the second window 36 and the mull between the second window 36 and third window 38 are sealed. As shown in FIGS. 13, 14, 15, 18 and 19 a sealing connector 106, 156 is positioned external to the mull connector on the exterior side 24 of each mull. In an embodiment, a sealing block (not shown) may be filled with silicone caulking to complete the sealing of the mulls. At block 420 of FIG. 4, trim connectors are attached to the mulls as shown in FIGS. 13, 14, 15, 18 and 19. A trim connector 102, 152 is positioned external to the mull connector 100, 150 on an interior side 26. At block 422, trim is attached to the interior side 26 and exterior side 24 to complete the mull assembly. As shown in FIGS. 13, 14, 15, 18 and 19, the exterior trim 108, 158 is positioned external to the sealing connector 106, 156 on the external side 24 and the interior trim 104, 154 is attached external to the trim connector 102, 152 on the interior side 26. FIGS. 14 and 19 show competed mull assemblies in accordance with various embodiments. FIG. 20 shows a completed mulled window 170. In FIG. 20, a first window 34, a second window 36 and a third window 38 are installed and field mulled in the opening 14 of the wall frame 12.

Figure 21:
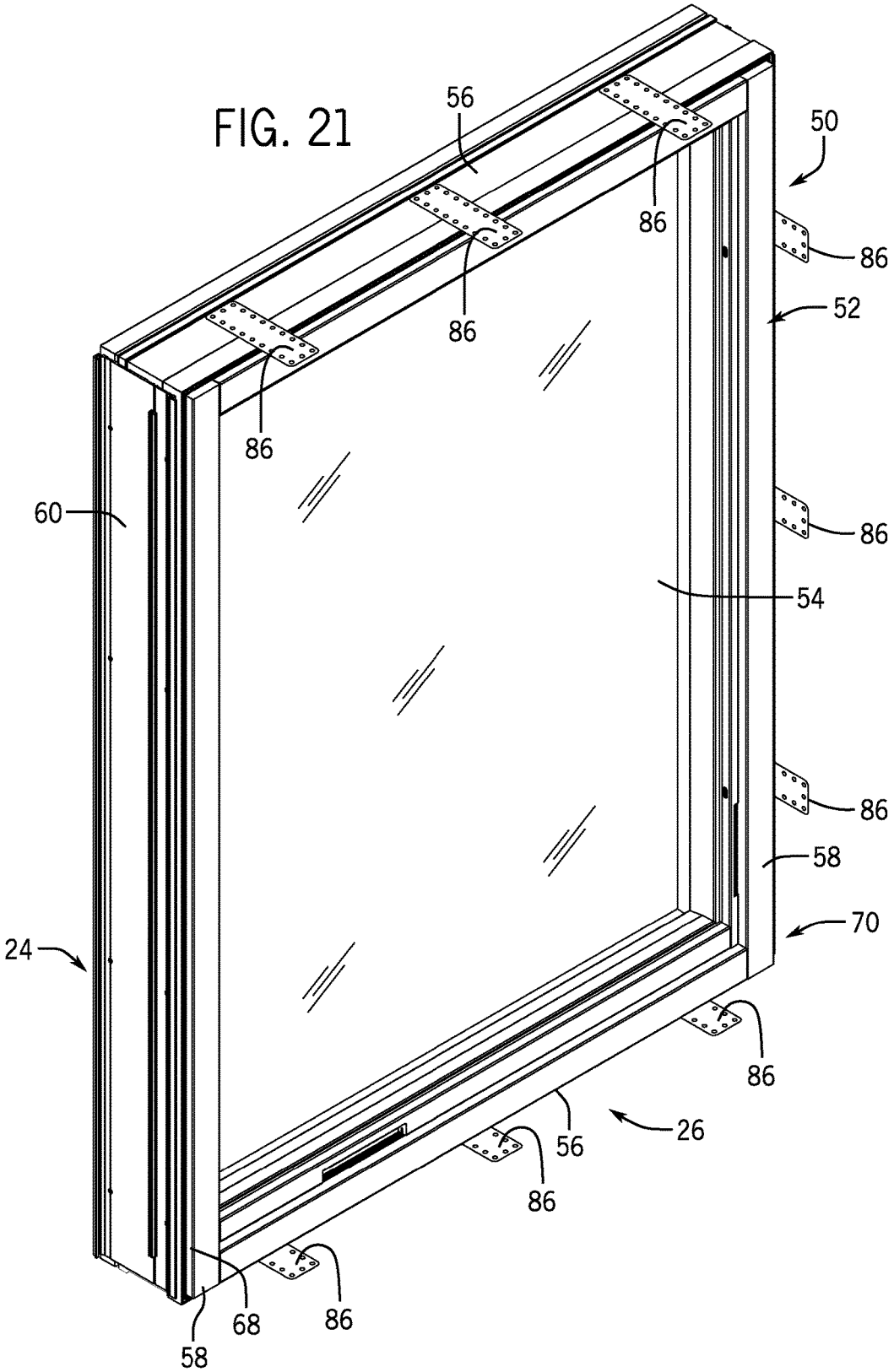
FIG. 21 is a perspective view of a window with a mull halve in accordance with an embodiment.
Figure 22:
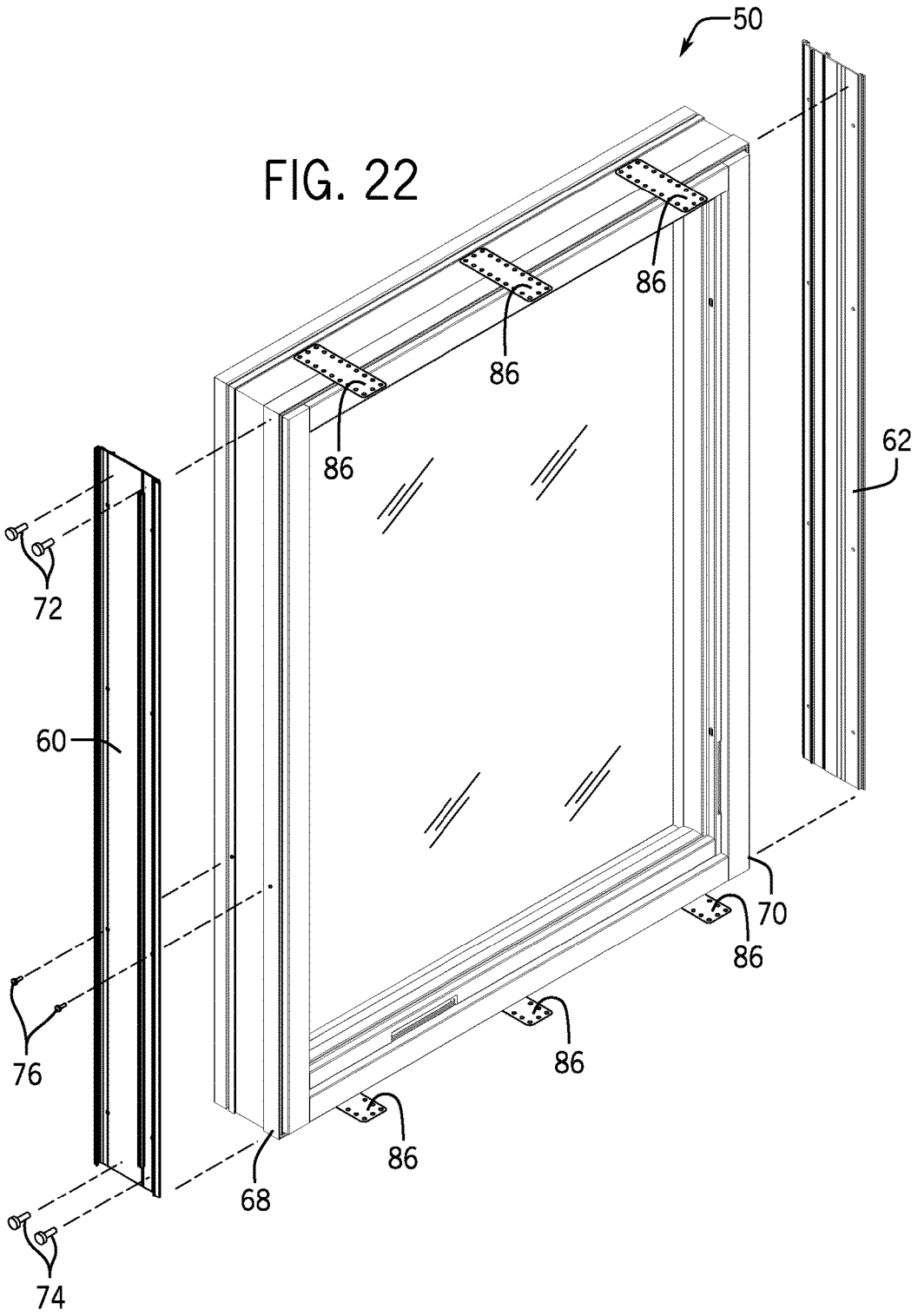
FIG. 22 is a perspective view of a window and a pair of mull halves in accordance with an embodiment.

As discussed above with respect to FIGS. 2, 3, 4, 6 and 7, an upper mull bracket 64 and a lower mull bracket 66 may be used to attach a window (e.g., first window 34, second window 36, third window 38) to a wall frame 12. In an alternative embodiment, a set of straps may be used to connect the window to the wall frame 12. The straps may be connected to the window on the sides of the window frame that do not have a mull halve. FIG. 21 is a perspective view of a window with a mull halve in accordance with an embodiment. In this embodiment, straps 86 are attached to the upper and lower rails 56 and to the stile 58 on the second side 70 of the window 50. A mull halve 60 is attached to a first side 68 of the window frame 62, In FIG. 21, three straps 86 are positioned on each of the upper and lower rails 56 and three straps 86 are positioned on the stile 58, however, in various embodiments, a different number of straps 86 may be used. For a window that has two mull halves, such as the window shown in FIG. 3, the straps 86 may be attached to the upper and lower rails 56 as shown in FIG. 22. In FIG. 22, a mull halve 60 is attached to a first side 68 of the window 50 and a mull halve 62 is attached to a second side 70 of the window 50.

Figure 23:
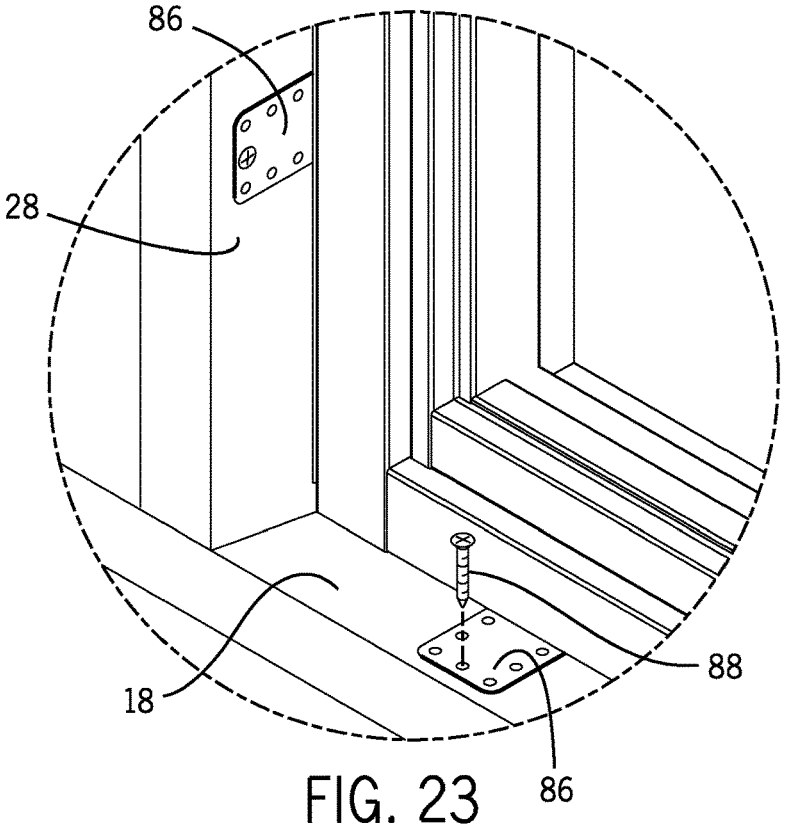
FIG. 23 is a view of straps attached to a jamb and sill of a wall frame in accordance with an embodiment.
Figure 24:
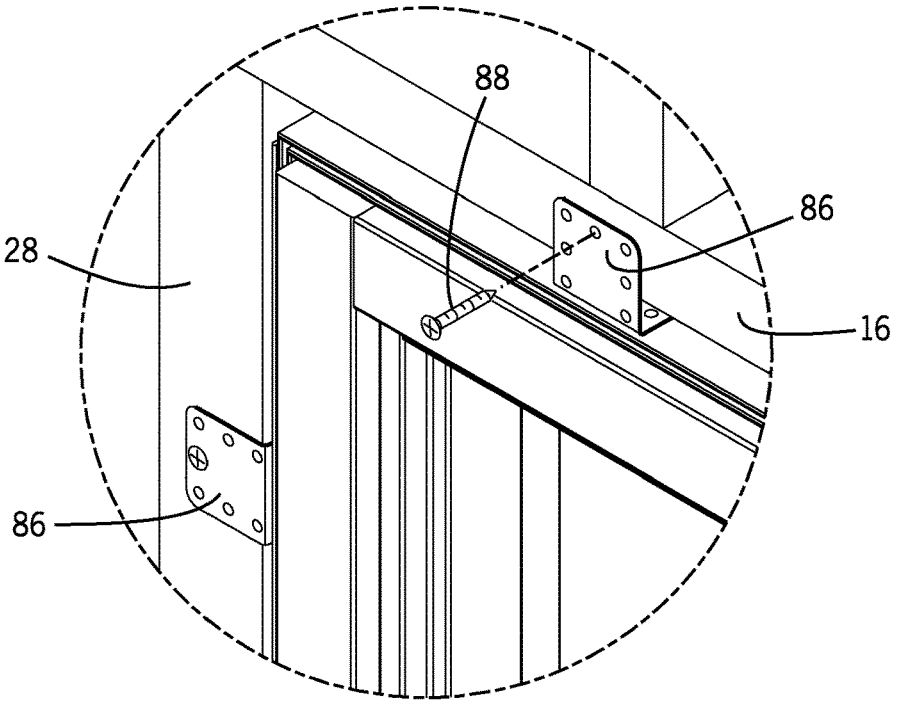
FIG. 24 is a view of straps attached to a jamb and header of a wall frame in accordance with an embodiment.

The straps 86 may be attached to the window frame 52 using mechanical fasteners, such as, for example, screws, In addition, the straps may be attached to the wall frame 12 using mechanical fasteners as shown in FIGS. 23 and 24. In FIG. 23, straps 86 are shown attached to a jamb 28 and a sill 18. For example, a strap 86 is connected to the sill 18 using a mechanical fastener 88. If the depth of the wall frame provides sufficient space, the strap 86 may be connected to the wall frame in a flat configuration as shown in FIG. 23. If, however, the depth of the wall frame does not have sufficient space, the straps 86 may be bent to attach to the wall frame as shown in FIG. 24. In FIG. 24, straps 86 are shown attached to a jamb 28 and a header 16. For example, a strap 86 is connected to the header 16 using a mechanical fastener 88. The straps 86 may be constructed from a metal, for example, galvanized steel.

Figure 27:
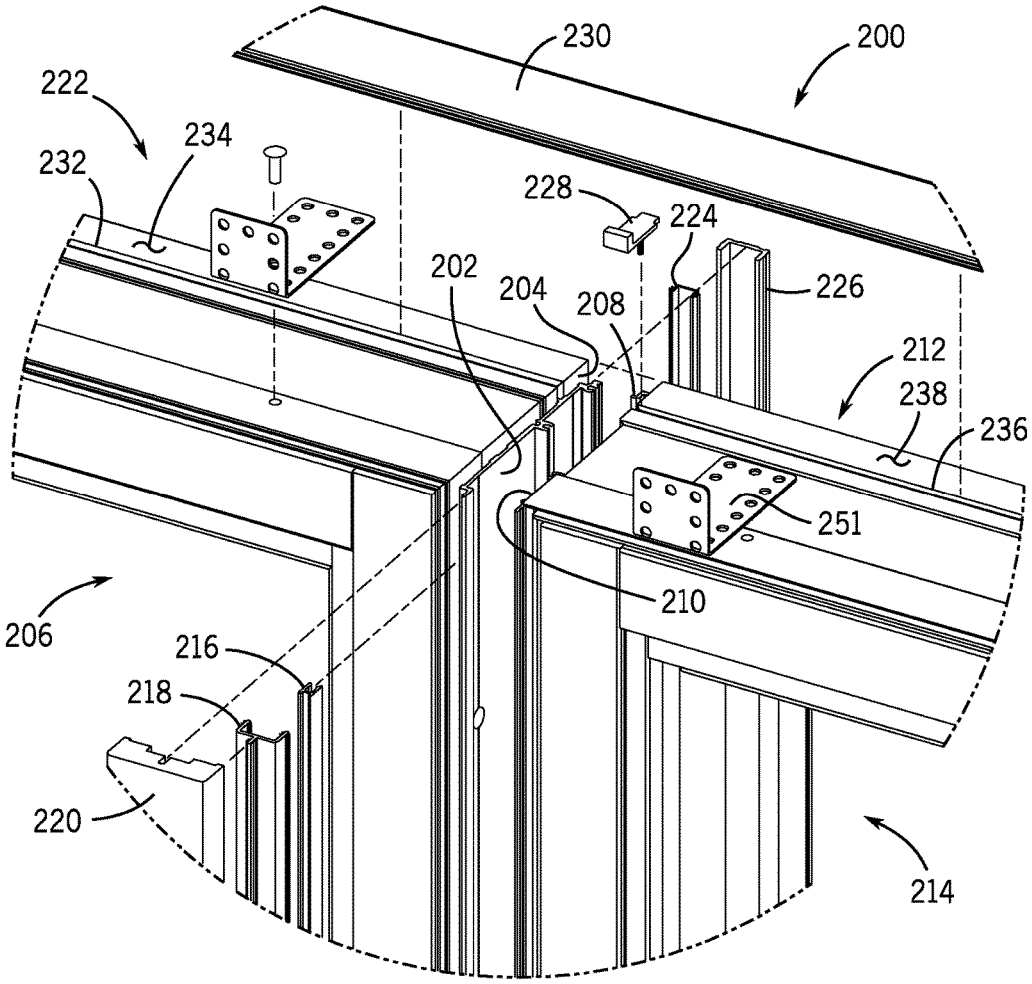
FIG. 27 is a perspective view of components of a mull assembly in accordance with an embodiment.

Referring to FIG. 27, a mull assembly 200 consists of a first mull halve 202 on a first side 204 of a first window 206 and a second mull halve 208 on a second side 210 of a second window 212. On an interior side 214, a mull connector 216, a trim connector 218 and an interior trim 220 are used to secure together the mull halves 202 and 208. On the exterior side 222, a sealing connector 224 and exterior trim 226 are used to secure together the mull halves 202 and 208. A sealing cap 228 is positioned above upper edges of the first mull halve 202 and second mull halve 208 proximate the exterior side 222 as will be discussed in further detail below.

A flashing fin 230 is positioned within a groove 232 extending into an upper surface 234 of first window 206 and within a groove 236 extending into an upper surface 238 of second window 212. Grooves 232 and 236 extend generally perpendicular into the top surface 234 and 238 of first window 206 and second window 212 respectively in a direction toward the bottom of first window 206 and second window 212 respectively. Or stated another way, when the windows are in an installed position within a building having vertical walls, the groove extends downward in the direction of gravity.

Figure 25:
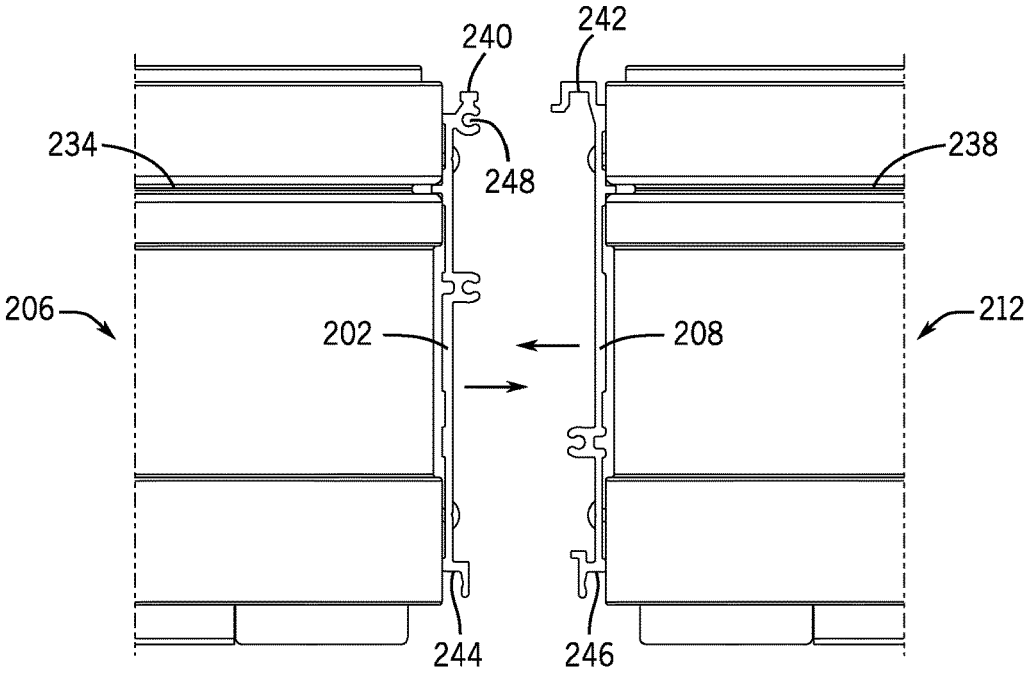
FIG. 25 is a top view of two mull halves in accordance with one embodiment.

Referring to FIG. 25, first mull halve 202 is secured to first window 206 and a second mull halve 208 is secured to second window 212. The first mull halve 202 and second mull halve 208 are secured with a fastener is known in the art such as nails, screws, adhesive or other fasteners known in the art. First mull halve 202 includes a first or exterior end 240 that is closer to the exterior of a building than second or interior end 244. Exterior end 240 includes an opening 248 that receives a portion of sealing cap 228. Second mull halve 208 includes an exterior end 242 and an interior end 246.

Figure 26:
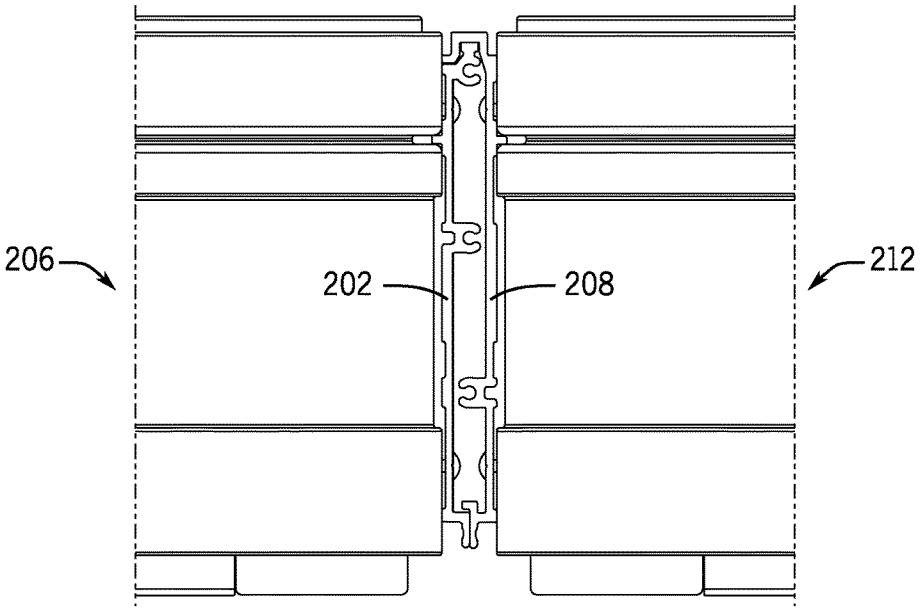
FIG. 26 is a top view of two mull halves of FIG. 25 in an adjacent position.

Referring to FIG. 26, first mull halve 202 and second mull halve 208 interact with one another to secure first window 206 and second window 212 together. Exterior end 242 of second mull halve 208 goes over and around the exterior end 240 of first mull halve 202. The interior end 244 and the interior end 246 of first mull halve 202 and second mull halve 208 respectively are coupled together with the mull connector 216.

Figure 28:
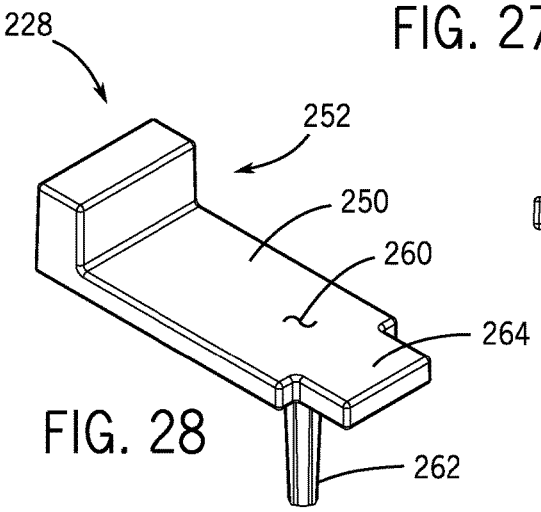
FIG. 28 is a perspective view of a sealing cap.
Figure 29:
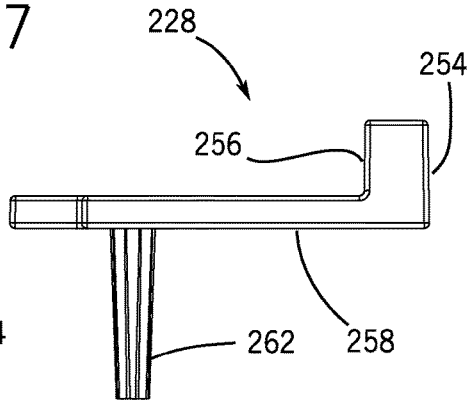
FIG. 29 is a side view of the sealing cap of FIG. 28.

Referring to FIG. 28, sealing cap 228 includes a first leg 250 and a second leg 252 that extends perpendicular to first leg 250. First leg 250 includes an upper surface 260 and a terminal free end 264 that is distal from second leg 252. First leg 250 has a bottom surface 258 which is opposite to and generally offset and parallel to surface 260. Extending from bottom surface 258 in direction away from top surface 260 is an extension member 262. In one embodiment, extension member has a terminal end distal from lower surface 258 that has a cross-sectional area that is less than the cross-sectional area of a region of the extension member 262 proximate to the lower side or lower surface 258 of first leg 250. Second leg 252 has a first or interior side 254 and a second or exterior surface 256 that is closer to terminal free end 264 of first leg 250 than interior surface 254. In one embodiment terminal free end 264 has a width defined by the direction perpendicular to the vector direction between upper surface 260 and lower surface 258 and perpendicular to the longitudinal axis of extension member 262. The width of terminal free end 264 in one embodiment is less than the width of first leg 250 proximate second leg 252. The narrower width proximate terminal free end 264 allows for interaction with the legs of sealing connector 224.

Figure 30:
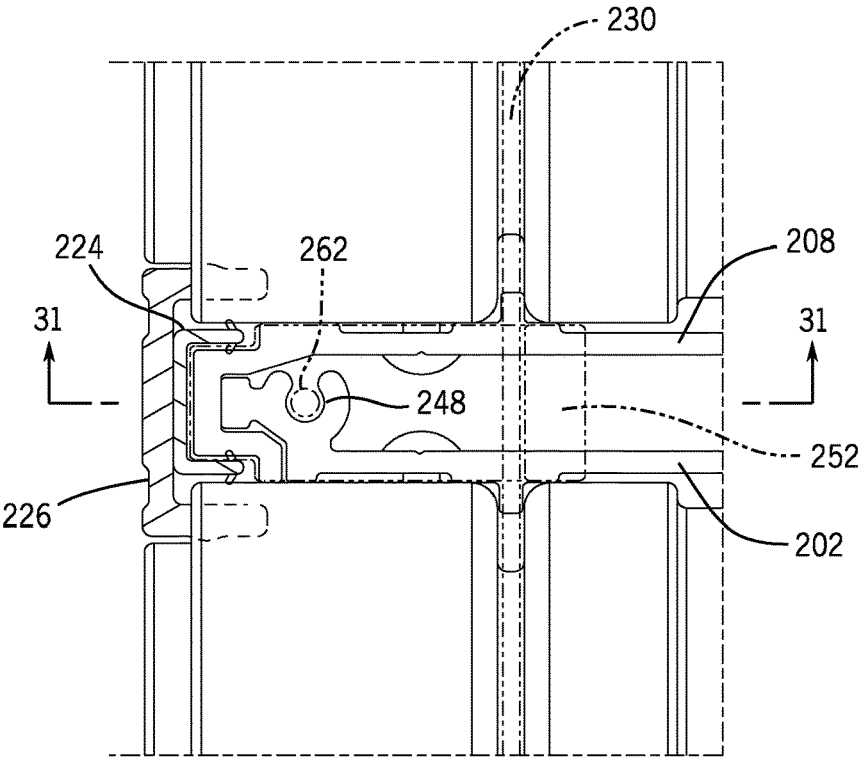
FIG. 30 is a partial top view of the exterior portion of the mull assembly in the region of the sealing cap.
Figure 31:
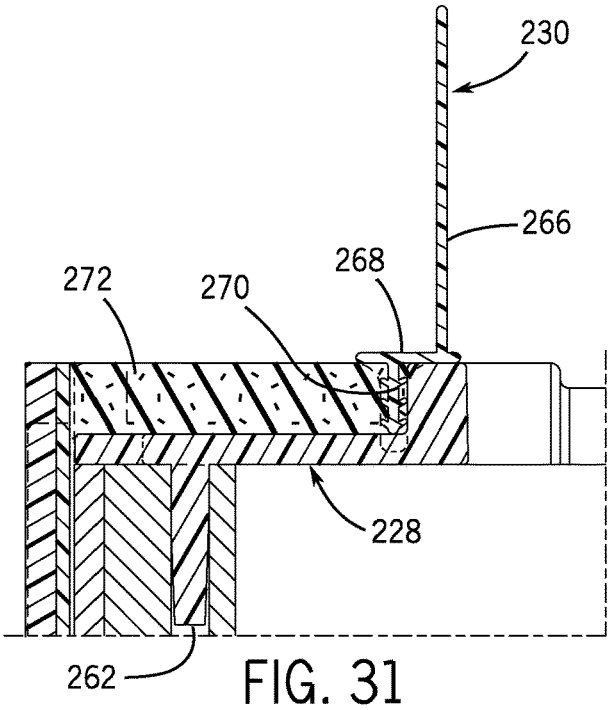
FIG. 31 is a cross sectional view of the flashing fin, sealing cap and mull assembly taken generally along line 31-31 of FIG. 30.

Referring to FIG. 30 and FIG. 31, sealing cap 228 is positioned between first window 206 and second window 212 and directly above the upper terminal ends of first mull halve 202 and second mull halve 208. Bottom surface 258 of sealing cap 228 is directly adjacent and contacting the upper terminal edges of first mull halve 202 and second mull halve 208. Additionally upper surface 260 defines a plane that is not coplanar with upper surface 234 of first window 206 and upper surface 238 of second window 212. The upper surface 260 defines a plane that is a distance below upper surface 234 and 238. The upper surface of second leg 252 is coplanar with upper surface 234 and upper surface 238 of first window 206 and second window 212 respectively. Sealing cap 228 is positively located and positioned relative to first mull halve 202 and second mull halve 208 by positioning extension member 262 within opening 248. Opening 248 is part of first mull halve 202 that extends the entire length of mull halve 202. In this manner sealing cap 228 is positively located within mull assembly 200. Mull halve 202 and mull halve 208 are operably secured to first window 206 and second window 212 by fasteners as may be known in the art such as screws, rivets or other connectors including but not limited to adhesives. First mull halve 202 may be positively located relative to first window 206 by a tab or other extension member extending from mull halve 202 within a groove or kerf that extends vertically along the surface 204 of first window 206. The groove or kerf that extends vertically along the surface 204 is aligned with groove 232. In this manner, first mull halve 202 and second mull halve 208 are positively aligned with groove 232 and 236. Since sealing cap 228 is positively aligned with first mull halve 202 via location of extension member 262 within extruded boss or opening 248, sealing cap 228 is positively aligned with groove 232 and 236.

In one embodiment the bottom surface 258 of sealing cap 228 may have cavities that extend upwardly toward upper surface 260 of sealing cap 228. Silicone or other sealant known in the art is placed in the cavities prior to locating sealing cap 228 on top of mull halves 202 and 208 to provide a water tight seal between the sealing cap 228 and the mull halves.

Exterior surface 256 of second leg 252 is located intermediate of a line defined by groove 232 and groove 236 and the exterior side of first window 206 and second window 212. In this manner leg 250 is on one side of the line defined by first groove 232 and second groove 236, and second leg 252 is located on the other side of the line defined by first groove 232 and second groove 236.

Referring to FIG. 31, flashing fin 230 includes a first member 266 that extends upward from surface 234 and surface 238 of first window 206 and second window 212 respectively. Flashing fin 230 also includes a second leg 268 that extends perpendicular from first member 266 in direction parallel to first surface 234 and second surface 238 the first window 206 and second window 212 respectively. A bottom surface of second leg 268 is in contact with the upper surface of second leg 252 of sealing cap 228. Extending downward from a bottom surface of second leg 268 of flashing fin 230 is an engagement leg 270. In one embodiment, engagement leg 270 includes a plurality of barbs that engage into first groove 232 of first window 206 and second groove 236 of second window 212. Flashing fin 230 is situated such that a portion of engagement leg 270 is located adjacent to exterior surface 256 of second leg 252 and a bottom edge of engagement leg 270 is located adjacent to top surface 260 of first leg 250.

Referring to FIG. 31, a pocket is defined by the space above surface 260 of first leg 250 and between the first 206 and second window 212, and between exterior surface 256 of second leg 252 and sealing connector 224. The opening of the pocket is co-planar with the surface 234 and surface 238 of first window 206 and second window 212 respectively. A sealant material 272 is deposited in the pocket to create a seal between the first window 206 and second window 212 between finishing fin 230 and sealing connector 224. In one embodiment, the sealant material 272 is silicone. In one embodiment a sealant known in the art may be used to provide a water tight seal between finishing fin 230, first window 206, second window 212, and mull halves 202 and 208. Finishing fin 230 is secured to the outside of a building structure as is known in the art.

Although sealing cap 228 has been described in connection with mull assembly 200, sealing cap 228 may be use with the other mull assembly embodiments described herein as well. Although the example provided identified windows any fenestration assembly may be mulled together as outlined above in the various embodiments including but not limited to doors. Although not described above straps 251 are secured to the upper surfaces of the first window and second window to aid in securing the first window and second window to a building structure. Straps 251 may be rigid or flexible and bent as needed to optimize installation of the mulled windows to a building structure. In one embodiment straps 251 have a plurality of apertures through which a fastener such as a screw or mail may secure the straps 251 to the windows and building structure.

It is important to note that the construction and arrangement of system for field mulling of a plurality of fenestration assemblies as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A system for mulling a plurality of fenestration assemblies in an opening, the system comprising:

a first fenestration assembly having a top surface and a first groove extending along a length of the top surface;

a second fenestration assembly having a top surface and a second groove extending along a length of the top surface;

a first mull halve coupled to the first fenestration assembly;

a second mull halve coupled to the second fenestration assembly, wherein the second fenestration assembly is positioned so that the second mull halve is adjacent the first mull halve; and a sealing cap being positioned on top of the first mull halve and the second mull halve, the sealing cap having:

a first portion positioned on a first side of a groove line defined by the first groove along the length of the top surface of the first fenestration assembly and the second groove along the length of the top surface of the second fenestration assembly, the first portion having a top surface and a bottom surface, the top surface positioned a distance below the top surface of the first fenestration assembly and the top surface of the second fenestration assembly;

a second portion positioned only on a second opposite side of the groove line, the second portion being perpendicular to the first portion and having a top surface that is coplanar with the top surface of the first fenestration assembly and the top surface of the second fenestration assembly.

2. The system of claim 1, wherein a pocket is formed between the top surface of the sealing cap and the top surface of the first fenestration assembly and the top surface of the second fenestration assembly.

3. The system of claim 1, further including a flashing fin having a lower edge positioned within the first groove and the second groove, wherein the first portion of the sealing cap is on a first side of the flashing fin and the second portion of the sealing cap is only on a second side of the flashing fin, wherein the second side of the flashing fin is opposite the first side of the flashing fin.

4. The system of claim 1, wherein the first mull halve has an interior tab on an interior side and the second mull halve has an interior tab on an interior side and wherein an H-shaped mull connector joins the interior tab of the first fenestration assembly mull halve and the interior tab of the second fenestration assembly mull halve.

5. A system according to claim 4, further comprising a trim connector coupled to the interior side of the first mull halve and the interior side of the second mull halve.

6. A system according to claim 5, further comprising an interior trim coupled to the trim connector.

7. A system according to claim 4, further comprising a sealing connector coupled to an exterior side of the first mull halve and an exterior side of the second mull halve.

8. A system according to claim 7, further comprising an exterior trim coupled to the exterior side of the first mull halve and the exterior side of the second mull halve, wherein the exterior trim is external to the sealing connector.

9. A system according to claim 1 wherein the first mull halve has a hook-shaped connector on an exterior side and the second mull halve has an exterior tab on an exterior side and wherein the exterior tab is configured to be received by the hook-shaped connector to join the first mull halve and the second mull halve.

10. A system according to claim 1, wherein the first mull halve has an exterior tab on an exterior side and the second mull halve has an exterior tab on an exterior side and wherein an H-shaped mull connector joins the exterior tab of the first mull halve and the exterior tab of the second mull halve.

11. The system of claim 1 further including a flashing fin having a lower edge positioned within the first groove and the second groove, wherein the first portion of the sealing cap is on a first side of the flashing fin and the second portion of the sealing cap is only on a second side of the flashing fin, wherein the second side of the flashing fin is opposite the first side of the flashing fin;

the flashing fin including a first member that extends in a first direction from the top surface of the first window and the top surface of the second window, the flashing fin including an engagement leg having a portion positioned adjacent to an exterior surface of the second portion of the sealing cap and a bottom free edge of the engagement leg is located closely adjacent the top surface of the first portion.

12. The system of claim 1, wherein the sealing cap includes an extension member extending from the bottom surface of the first portion.

13. A system for mulling a plurality of fenestration assemblies in an opening, the system comprising:

a first fenestration assembly having a top surface and a first groove extending along a length of the top surface;

a second fenestration assembly having a top surface and a second groove extending along a length of the top surface;

a first mull halve coupled to the first fenestration assembly;

a second mull halve coupled to the second fenestration assembly, wherein the second fenestration assembly is positioned so that the second mull halve is adjacent the first mull halve;

a flashing fin having an engagement leg positioned within the first groove and the second groove; and a sealing cap covering a portion of the first mull halve and the second mull halve, the sealing cap having:

a first portion positioned on a first side of a groove line defined by the first groove and the second groove, the first portion having a top surface and a bottom surface, the top surface positioned a distance below the top surface of the first fenestration assembly and the top surface of the second fenestration assembly;

a second portion positioned only on a second opposite side of the groove line, the second portion being perpendicular to the first portion and having a top surface that is coplanar with the top surface of the first fenestration assembly and the top surface of the second fenestration assembly; and wherein the first portion of the sealing cap is adjacent to a first portion of the engagement leg of the flashing fin and the second portion of the sealing cap is adjacent to a second portion of the engagement leg of the flashing fin.

14. The system of claim 13, wherein a pocket is formed between a first surface of the sealing cap and the top surface of the first fenestration assembly and the top surface of the second fenestration assembly.

15. The system of claim 13, wherein the sealing cap includes an extension member extending from the bottom surface of the first portion.

* * * * *